US011485158B2

(12) United States Patent
Okawa et al.

(10) Patent No.: US 11,485,158 B2
(45) Date of Patent: Nov. 1, 2022

(54) TRANSPORT APPARATUS AND RECORDING APPARATUS

(71) Applicant: Seiko Epson Corporation, Tokyo (JP)

(72) Inventors: Soshi Okawa, Shiojiri (JP); Satoshi Tamai, Matsumoto (JP); Shomaru Kondo, Shimosuwa-machi (JP); Yuki Komatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/329,402

(22) Filed: May 25, 2021

(65) Prior Publication Data

US 2021/0370689 A1 Dec. 2, 2021

(30) Foreign Application Priority Data

May 28, 2020 (JP) ..... JP2020-093027

(51) Int. Cl.

| | |
|---|---|
| ***B41J 11/58*** | (2006.01) |
| ***B41J 13/10*** | (2006.01) |
| ***B41J 29/13*** | (2006.01) |
| ***B41J 11/00*** | (2006.01) |

(52) U.S. Cl.

CPC ..... *B41J 13/103* (2013.01); *B41J 11/007* (2013.01); *B41J 11/58* (2013.01); *B41J 29/13* (2013.01)

(58) Field of Classification Search

CPC ..... B41J 11/58; B41J 13/103; B41J 29/13

See application file for complete search history.

(56) References Cited

U.S. PATENT DOCUMENTS

2015/0035220 A1* 2/2015 Nunokawa ..... B65H 5/26 271/4.03

2018/0029393 A1* 2/2018 Matsumoto ..... B41J 13/106

FOREIGN PATENT DOCUMENTS

JP 2018-016480 2/2018

* cited by examiner

*Primary Examiner* — Matthew Luu
*Assistant Examiner* — Kendrick X Liu
(74) *Attorney, Agent, or Firm* — Workman Nydegger

(57) ABSTRACT

A transport apparatus includes a mounting section on which a medium is to be mounted, a drive section configured to drive the mounting section in a moving direction and a protection section configured to be switched between a protection state for protecting the drive section and a release state for releasing protection of the drive section. The mounting section has a driven section that engages with the drive section and is driven by the drive section. When the driven section driven by the drive section engages with the drive section, the protection section is in the release state, and when the driven section does not engage with the drive section, the protection section is in the protection state.

14 Claims, 19 Drawing Sheets

| STATE OF STACKER | | A4 POSITION SENSOR | A3 POSITION SENSOR |
|---|---|---|---|
| A | ACCOMMODATED STATE | OFF | OFF |
| B | A4-SIZE STATE | ON | OFF |
| C | A3-SIZE STATE | ON | ON |
| D | DETACHED STATE | OFF | OFF |

TRANSPORT APPARATUS AND RECORDING APPARATUS

The present application is based on, and claims priority from JP Application Serial Number 2020-093027, filed May 28, 2020, the disclosure of which is hereby incorporated by reference herein in its entirety.

BACKGROUND

1. Technical Field

The present disclosure relates to a transport apparatus and a recording apparatus.

2. Related Art

A recording apparatus described in JP-A-2018-16480 has a discharge tray that can be moved from or into an apparatus body. The discharge tray can be moved outward or inward by a driving force transmitted via a tray drive gear train to a drive rack unit of the discharge tray.

In the structure in JP-A-2018-16480, however, when the discharge tray is moved outward with respect to the apparatus body, the drive section is exposed and dust or the like entered from the outside of the apparatus body may accumulate on the driving section.

SUMMARY

According to an aspect of the present disclosure, a transport apparatus to solve the above-mentioned problem includes a mounting section on which a medium is to be mounted, the mounting section being configured to be moved, as a moving direction, in a pull direction in which the mounting section is pulled from an apparatus body or in an accommodation direction opposite to the pull direction, a drive section configured to drive the mounting section in the moving direction, and a protection section configured to be switched between a protection state for protecting the drive section and a release state for releasing protection of the drive section, in which the mounting section has a driven section that engages with the drive section and is driven by the drive section, when the driven section engages with the drive section, the protection section is in the release state, and when the driven section does not engage with the drive section, the protection section is in the protection state.

DESCRIPTION OF EXEMPLARY EMBODIMENTS

Figure 1:
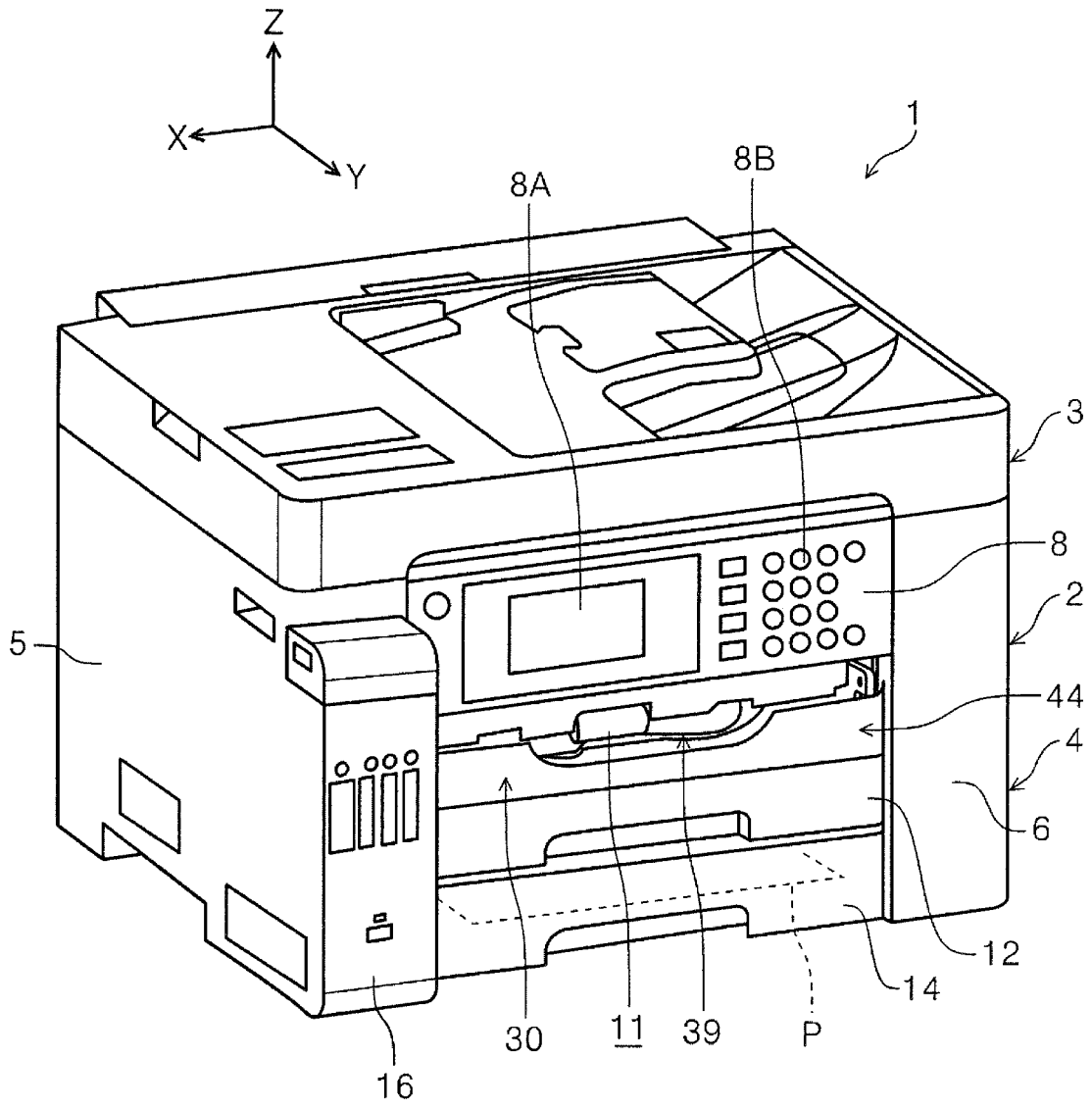
FIG. 1 is a perspective view of a printer according to a first embodiment viewed from the front.

Hereinafter, aspects of the present disclosure will be described. According to an aspect of the present disclosure, a transport apparatus to solve the above-mentioned problem includes a mounting section on which a medium is to be mounted, the mounting section being configured to be moved, as a moving direction, in a pull direction in which the mounting section is pulled from an apparatus body or in an accommodation direction opposite to the pull direction, a drive section configured to drive the mounting section in the moving direction, and a protection section configured to be switched between a protection state for protecting the drive section and a release state for releasing protection of the drive section. The mounting section has a driven section that engages with the drive section and is driven by the drive section. When the driven section engages with the drive section, the protection section is in the release state, and when the driven section does not engage with the drive section, the protection section is in the protection state.

According to the aspect, the mounting section is driven by the drive section and is moved in the pull direction or in the accommodation direction as a moving direction. When the engagement of the driven section with the drive section is released, the protection section is switched from the release state to the protection state to protect the drive section. With this structure, the protection section can prevent or reduce the entry of dust or the like from the outside of the apparatus body toward the drive section, thus preventing or reducing the accumulation of dust or the like entered from the outside of the apparatus body onto the drive section.

In the transport apparatus according to a second aspect, in the first aspect, the mounting section is configured to be detached from or attached to the apparatus body, and the protection section is in the protection state when the mounting section is detached from the apparatus body. When the mounting section is detached from the apparatus body, dust or the like is likely to accumulate on the drive section; however, according to the aspect, when the mounting section is detached from the apparatus body, the protection section is switched to the protection state. Accordingly, the accumulation of dust or the like onto the drive section when the mounting section is detached from the apparatus body can be prevented or reduced.

In the transport apparatus according to a third aspect, in the first aspect or the second aspect, the protection section covers in the protection state at least a portion of the drive section on a pull side. The portion of the drive section on the pull side is more likely to be exposed to dust or the like than the portion on an accommodation side; however, according to the aspect, in the protection state, the protection section covers at least a portion of the drive section on the pull side. Accordingly, when the mounting section is pulled further in the pull direction, the exposure of the part of the drive section can be prevented or reduced, and the accumulation of dust or the like onto the drive section can be effectively prevented or reduced.

In the transport apparatus according to a fourth aspect, in any one of the first aspect to the third aspect, the protection section includes a cover member configured to come into contact with the mounting section and to be moved to protect the drive section as the mounting section moves, and a support section configured to support the cover member in the protection state. According to the aspect, in the protection state, the support section supports the cover member. This structure can regulate the change in position of the cover member in the protection state, thus preventing or reducing the entry of dust or the like toward the drive section.

In the transport apparatus according to a fifth aspect, in the fourth aspect, the cover member is configured to be slid in a direction of height of the apparatus body and to be supported by the mounting section in the release state. According to the aspect, the cover member descends by its own weight and protects the drive section, thus eliminating any other structure for sliding the cover member to the protection position. In addition, in the release state, the cover member that descends by its own weight is supported by the mounting section, thus eliminating any other structure for supporting the cover member.

In the transport apparatus according to a sixth aspect, in the fifth aspect, the cover member extends downstream in the pull direction with respect to a downstream end of the support section. According to the aspect, the cover member extends in the pull direction, and an angle of the portion of the cover member that engages with the mounting section with respect to the moving direction can be gentle, and thus the cover member can be smoothly raised in attaching the mounting section to the apparatus body.

In the transport apparatus according to a seventh aspect, in the fourth aspect, the support section is a shaft extending in a direction intersecting the moving direction, and the cover member is configured to be turned about the shaft to be in the release state or the protection state as the mounting section moves. According to the aspect, the moving range of the portion of the cover member that turns about the shaft is narrower than the moving range of a portion of the cover member remote from the shaft. Accordingly, as compared to a structure in which the entire cover member slides in one direction, this structure enables the narrower moving range of the entire cover member, that is, the space for the cover member to move to the protection position is small, thus enabling the compact apparatus body.

In the transport apparatus according to an eighth aspect, in the seventh aspect, the cover member is configured to be supported by the mounting section in the release state. According to the aspect, in the release state, the cover member is supported by the mounting section and the movement of the cover member is regulated; accordingly, the position of the cover member can be held in the release state.

In the transport apparatus according to a ninth aspect, in any one of the fourth aspect to the eighth aspect, the cover member is moved by the mounting section that comes into contact with the cover member. According to the aspect, the mounting section comes into contact with the cover member and the cover member is moved. This structure directly changes the moving force of the mounting section into the moving force to the cover member, enabling effective use of the moving force of the mounting section in moving the cover member.

A recording apparatus according to a tenth aspect includes a recording section configured to perform recording on a medium, and the transport apparatus according to any one of the first aspect to the ninth aspect configured to transport the medium. According to the aspect, effects similar to those in any one of the first to the ninth aspect can be achieved.

Hereinafter, embodiments of the present disclosure will be described. In the drawings, an X direction along X-axis denotes an apparatus width direction and a sheet width direction. A negative X direction denotes a right direction when viewed from the user facing the apparatus front, and a positive X direction denotes a left direction. The X direction is an example intersecting direction. A Y direction along Y-axis denotes an apparatus depth direction and is an example moving direction of a stacker section 38, which will be described below. A positive Y direction denotes a direction from the apparatus rear toward the apparatus front and is an example pull direction for pulling the stacker section 38. A negative Y direction denotes a direction from the apparatus front toward the apparatus rear and is an example accommodation direction for accommodating the stacker section 38. A direction along Z-axis denotes a vertical direction. A positive Z direction denotes vertically upward, and a negative Z direction denotes vertically downward.

First Embodiment

Figure 2:
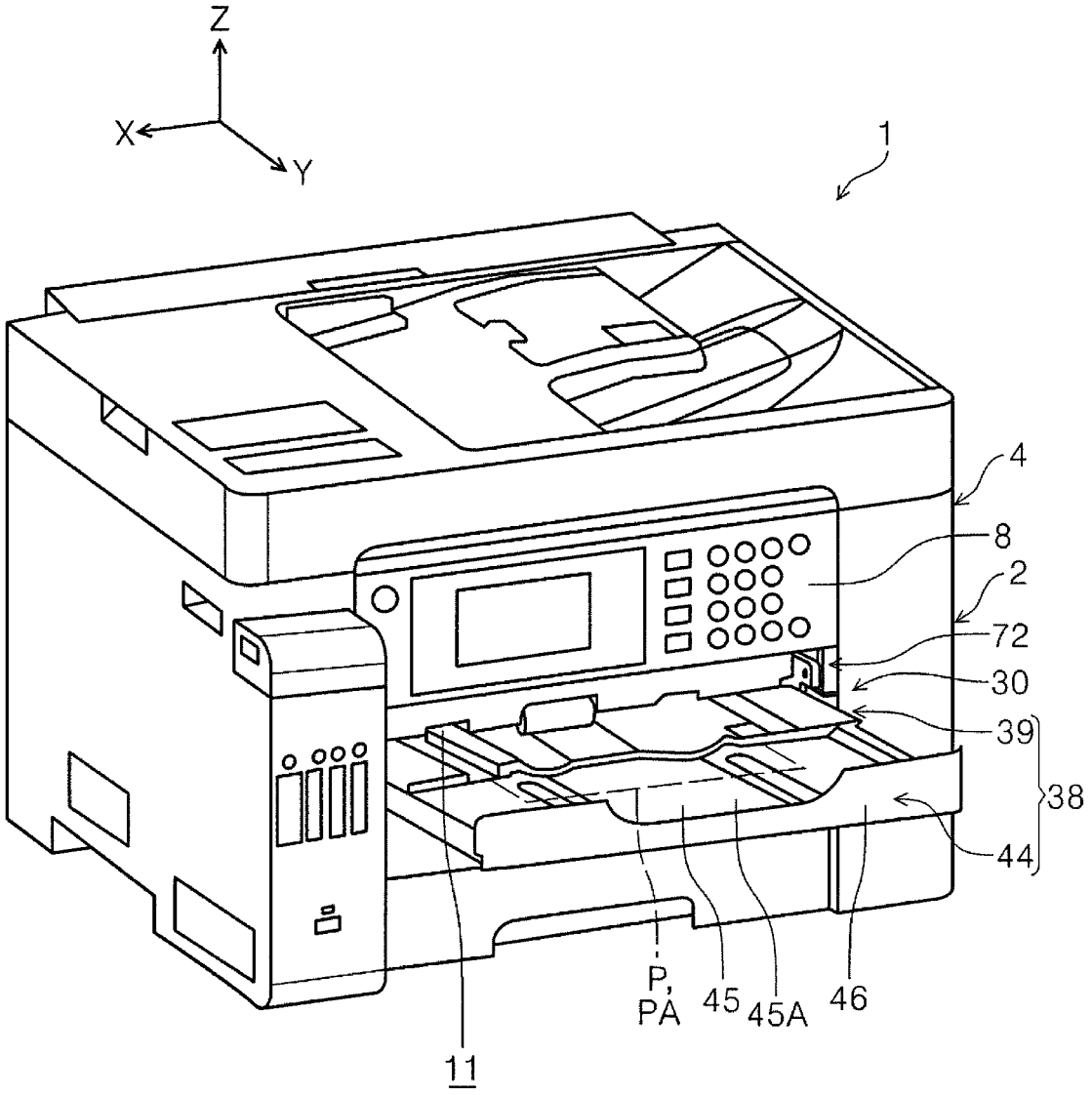
FIG. 2 is a perspective view of a stacker section pulled to an A4-size position according to the first embodiment.
Figure 3:
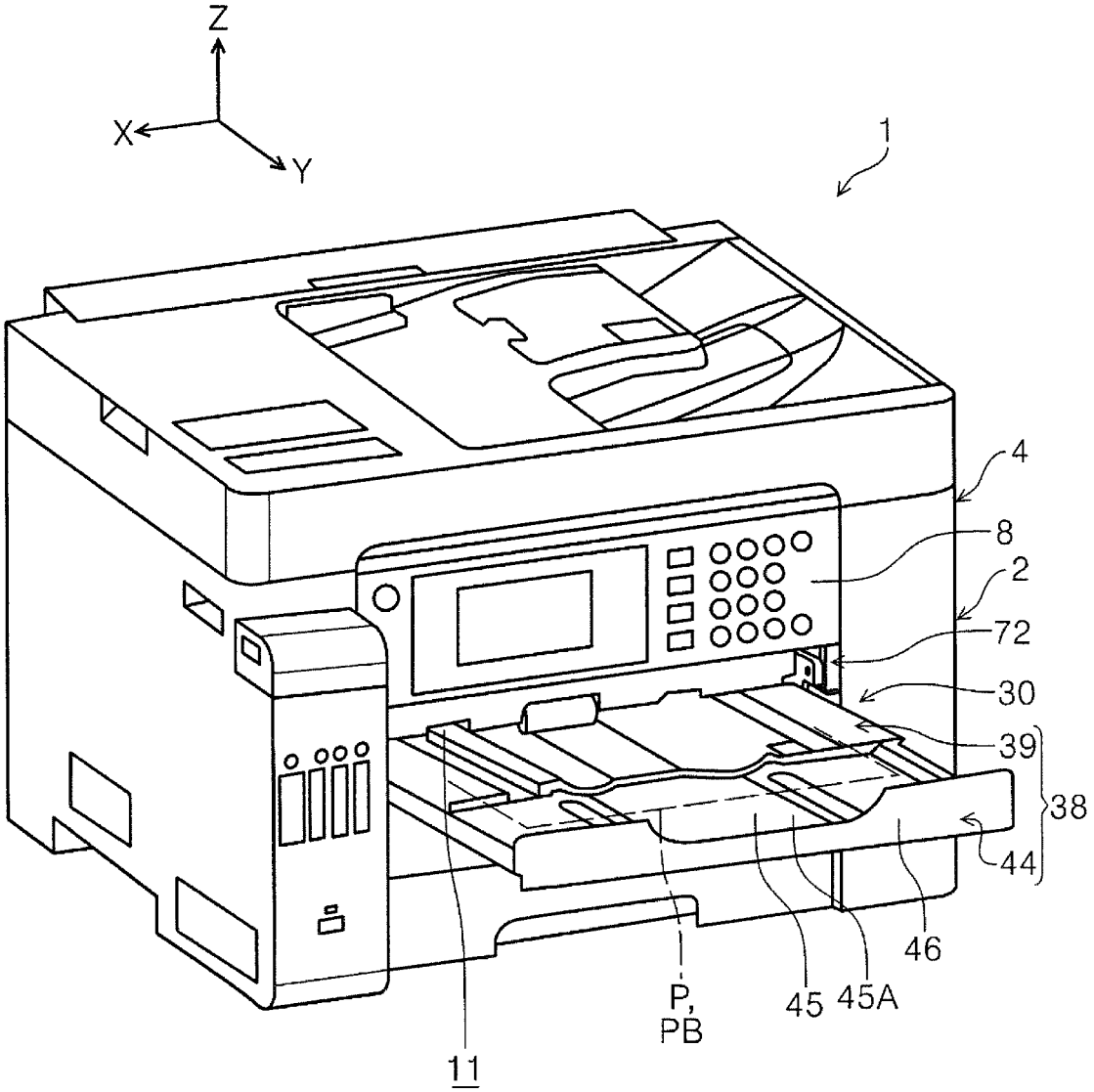
FIG. 3 is a perspective view of the stacker section pulled to an A3-size position according to the first embodiment.
Figure 4:
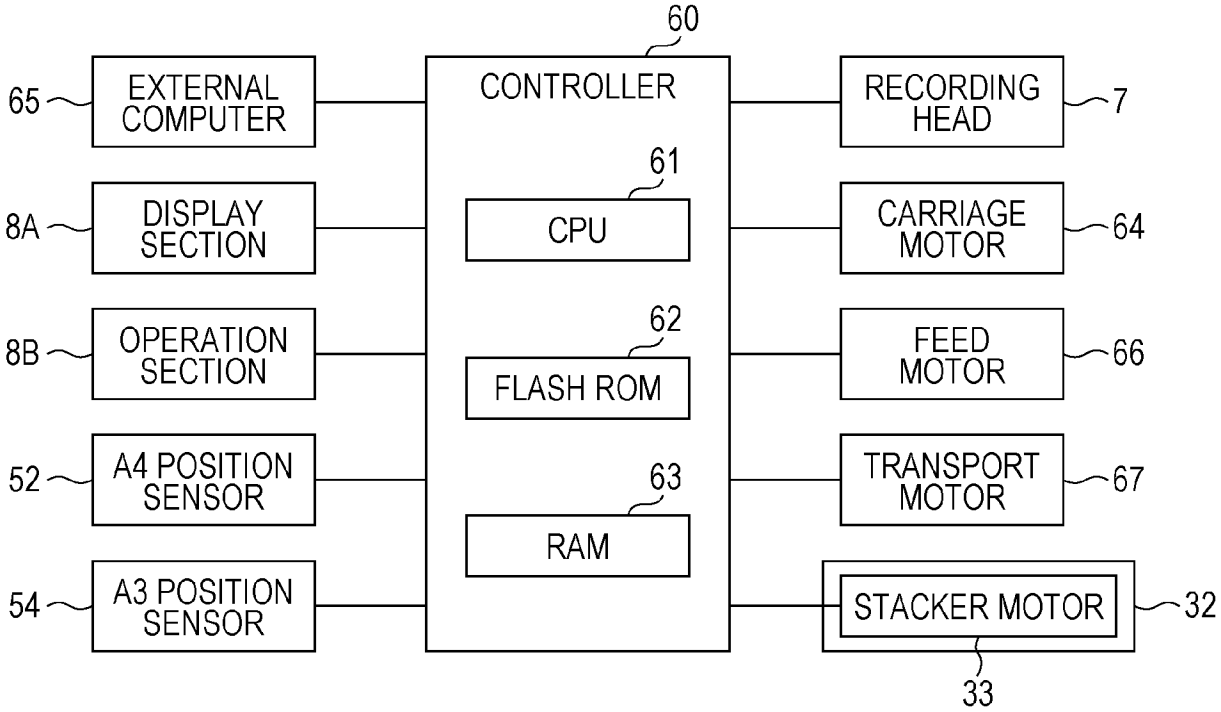
FIG. 4 is a block diagram illustrating main components of the printer according to the first embodiment.

FIG. 1 illustrates an ink jet printer 1 as an example recording apparatus. The printer 1 includes a recording head 7 (FIG. 4), which is an example recording section, and a transport unit 30 that transports paper P, which is an example medium. In FIG. 2 and FIG. 3, PA denotes an A4-size paper sheet P, and PB denotes an A3-size paper sheet P. The printer 1 also includes a body 2, which is an example apparatus body, and a scanner section 3 that is provided on an upper part of the body 2. The scanner section 3 has a function of reading documents. The body 2 includes a casing 4, the recording head 7 that performs recording with ink, sheet cassettes 12 and 14, an ink tank storage section 16, the transport unit 30, and a controller 60 (FIG. 4). The body 2 performs printing onto sheet P with the recording head 7. The body 2 includes, when viewed in the Y direction, a body left section 5 and a body right section 6, which are disposed upright in the Z direction respectively, and an operation panel 8. Each of the body left section 5 and the body right section 6 is a hollow member.

Figure 10:
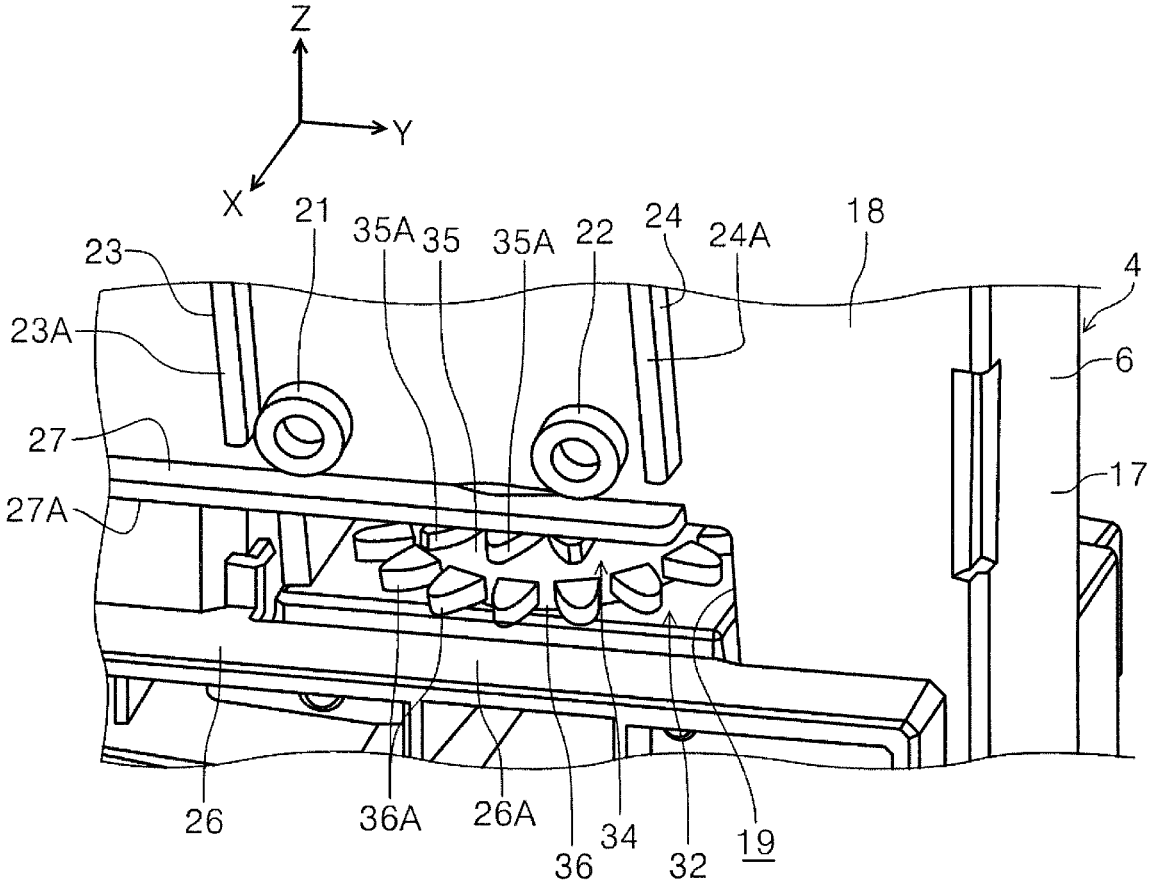
FIG. 10 is a perspective view of a pinion section according to the first embodiment.

As illustrated in FIG. 10, the body right section 6 includes a front wall 17 and a side wall 18. The front wall 17 is disposed upright along the X-Z plane. The side wall 18 extends in the negative Y direction from an end of the front wall 17 on the positive X side and is disposed upright along the Y-Z plane. The side wall 18 is a plate-like wall that has a predetermined thickness in the X direction. The side wall 18 has an opening 19 in a central portion along Z-axis and closer to the positive Y side than a central portion along Y-axis. The opening 19 extends through the side wall 18 in the X direction. The opening 19 is an elongated rectangular opening that is longer in the Y direction than in the Z direction when viewed in the X direction.

Figure 9:
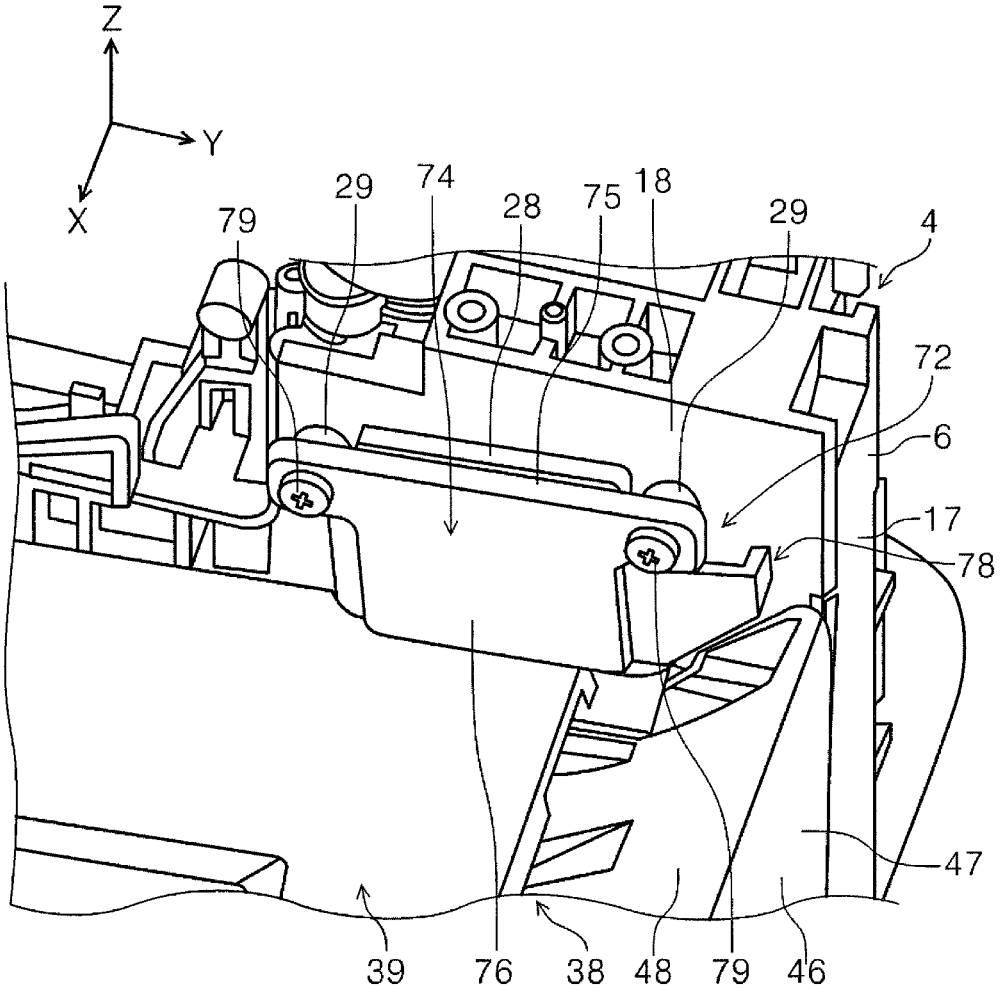
FIG. 9 is a perspective view in which the stacker section is accommodated and the protection section is in the release state according to the first embodiment.

The side wall 18 includes an insertion sections 21 and 22, guide rails 23 and 24, a lower guide 26, an upper guide 27, an upper wall section 28, and two bosses 29 (FIG. 9). Each of the insertion sections 21 and 22 has a cylindrical shape with a central axis extending in the X direction and protrudes in the positive X direction from a portion on the side wall 18 on the positive side along Z-axis with respect to the opening 19. The insertion section 21 is located on the negative side of Y-axis and the insertion section 22 is located on the positive side of Y-axis.

Each of the guide rails 23 and 24 has a predetermined thickness in the Y direction and is a plate-like section that protrudes from the side wall 18 in the positive X direction. The guide rail 23 extends in the positive Z direction at a position on the negative side of Y-axis with respect to the insertion section 21. An end surface 23A of the guide rail 23 on the positive side of X-axis is a plane along the Y-Z surface. The guide rail 24 extends in the positive Z direction at a position on the positive side of Y-axis with respect to the insertion section 22. An end surface 24A of the guide rail 24 on the positive side of X-axis is a plane along the Y-Z surface. The end surface 23A and the end surface 24A are closer to the positive side of X-axis than the insertion sections 21 and 22. An end of the guide rail 23 on the positive side of Z-axis and an end of the guide rail 24 on the positive side of Z-axis are coupled to the upper wall section 28 (FIG. 9). The bosses 29 (FIG. 9) are located on the negative side of Y-axis with respect to the guide rail 23 and on the positive side of Y-axis with respect to the guide rail 24 respectively. Each boss 29 has a screw hole (not illustrated).

The lower guide 26 has a predetermined thickness in the Z direction and is a plate-like section that protrudes in the positive X direction from the side wall 18. The lower guide 26 has an elongated rectangular shape that is longer in the Y direction than in the X direction when viewed in the Z direction. The lower guide 26 is aligned with an edge of the opening 19 in the side wall 18 on the negative side of Z-axis. The length of the lower guide 26 in the Y direction is longer than the length of the opening 19 in the Y direction. An end of a second stacker 44 (FIG. 2), which will be described below, on the negative side of X-axis is disposed on an upper surface 26A of the lower guide 26 on the positive side of Z-axis. With this structure, the lower guide 26 supports and guides a first stacker 39 in the Y direction.

The upper guide 27 has a predetermined thickness in the Z direction and is a plate-like section that protrudes in the positive X direction from the side wall 18. The upper guide 27 has an elongated rectangular shape that is longer in the Y direction than in the X direction when viewed in the Z direction. The upper guide 27 is aligned with an edge on the positive side of Z-axis of the opening 19 in the side wall 18. The length of the upper guide 27 in the Y direction is longer than the length of the opening 19 in the Y direction. A positive end of the upper guide 27 on Y-axis is closer to the negative side of Y-axis than a positive end of the lower guide 26 on Y-axis. An end of the first stacker 39 (FIG. 2), which will be described below, on the negative side of X-axis can come into contact with a lower surface 27A of the upper guide 27 on the negative side of Z-axis.

As illustrated in FIG. 1, the operation panel 8 includes a display section 8A and an operation section 8B for users to perform various operations and select settings to the printer 1. The operation section 8B is disposed so as to couple an upper portion of the body left section 5 and an upper portion of the body right section 6 in the X direction. In this structure, accordingly, a front opening 11 is on the negative side of Z-axis with respect to the operation section 8B. The sheet cassettes 12 and 14 are attached to the body 2 such that the sheet cassettes 12 and 14 can be attached or detached in the Y direction. The sheet cassettes 12 and 14 are accommodated in the body 2.

As illustrated in FIG. 2, the transport unit 30 includes a drive unit 32 (FIG. 4), the stacker section 38, and a protection section 72. The transport unit 30 includes an A4 position sensor 52 and an A3 position sensor 54 (FIG. 4), which will be described below. The drive unit 32, which is an example drive section, is disposed in the body 2. The drive unit 32 includes a stacker motor 33 (FIG. 4), a gear section (not illustrated), and a pinion section 34 (FIG. 10) and drives the stacker section 38 in the Y direction. The stacker motor 33 operates on the electric power supply from a power source (not illustrated) to transmit driving force to the gear section (not illustrated). The gear section transmits the driving force of the stacker motor 33 to the pinion section 34.

As illustrated in FIG. 10, the pinion section 34, which is a part of the drive unit 32, is adjacent to the opening 19; in other words, the pinion section 34 is exposed in the opening 19 on the X side. The outer periphery of the pinion section 34 partially protrudes in the positive X direction through the opening 19. More specifically, the pinion section 34 has a first gear 35 and a second gear 36. The first gear 35 and the second gear 36 are disposed on the same rotational axis along Z-axis to integrally rotate. The first gear 35 has teeth 35A on its outer periphery. The teeth 35A come into contact with a rack section 43 (FIG. 11) of the first stacker 39, which will be described below, and transmits the driving force of the stacker motor 33 (FIG. 4) to the first stacker 39. The second gear 36 is disposed at a position closer to the negative side of Z-axis than the first gear 35. The second gear 36 has teeth 36A on its outer periphery. The teeth 36A come into contact with a rack section 49 (FIG. 11) of the second stacker 44, which will be described below, and transmits the driving force of the stacker motor 33 to the second stacker 44.

As illustrated in FIG. 2, paper P is mounted on the stacker section 38, which is an example mounting section. The stacker section 38 can be moved in the positive Y direction, which is a pull direction, or in the negative Y direction that is opposite to the positive Y direction, which is an accommodation direction; in other words, the stacker section 38 can be moved in the Y direction. More specifically, the stacker section 38 includes the first stacker 39 and a second stacker 44. The second stacker 44 is disposed on the negative side of Z-axis with respect to the first stacker 39 and is supported by the first stacker 39. The second stacker 44 can be moved in the Y direction relative to the first stacker 39. With this structure, the second stacker 44 can be pulled in the positive Y direction further than the first stacker 39. The amount of pulling the first stacker 39 and the second stacker 44 in the positive Y direction can be changed to move (switch the position of) the stacker section 38 to an accommodation position in which the stacker section 38 is accommodated in the body 2, an A4 position that corresponds to A4-size paper PA, an A3 position (FIG. 3) that corresponds to A3-size paper PB, or an attachment/detachment position (FIG. 15) in which the stacker section 38 can be attached to or detached from the body 2.

Figure 11:
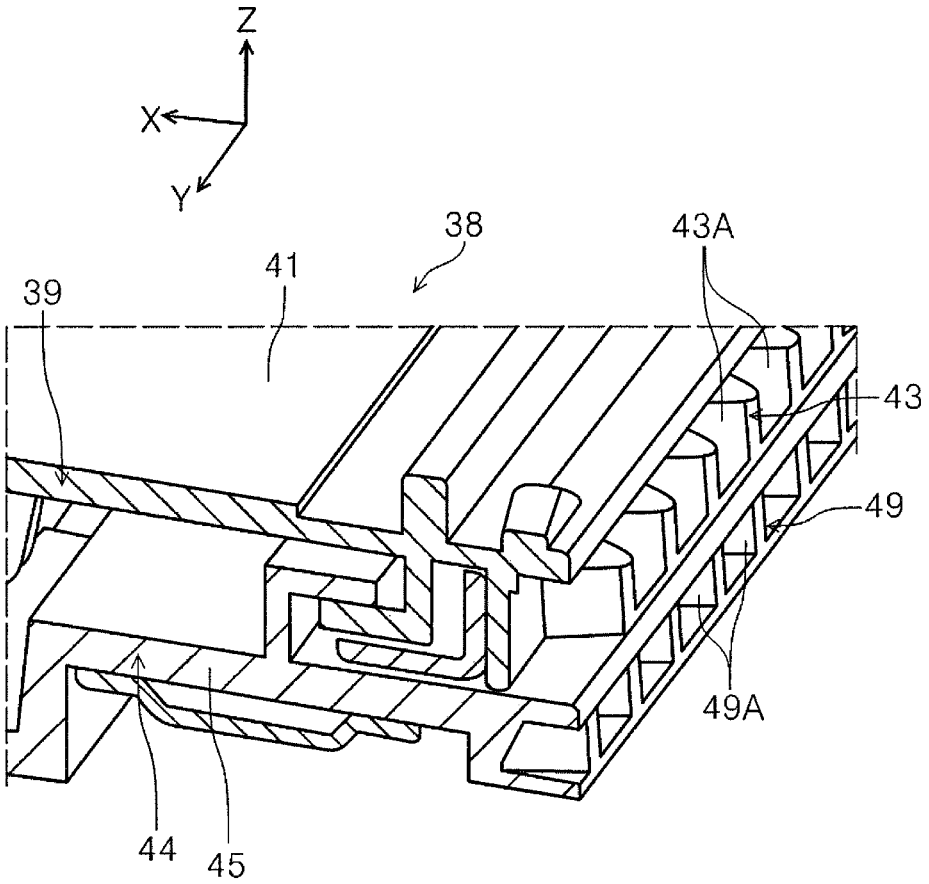
FIG. 11 is a perspective view of rack sections of the stacker section according to the first embodiment.

As illustrated in FIG. 11, the first stacker 39 is a plate-like member that has a predetermined thickness in the Z direction. Paper P is mounted on an upper surface 41 of the first stacker 39 on the positive side of Z-axis. A side of the first stacker 39 on the negative side of X-axis has the rack section 43. The rack section 43 extends in the Y direction. More specifically, the rack section 43 has recesses 43A that are recessed in the positive X direction and disposed along Y-axis at predetermined intervals. The recesses 43A and the teeth 35A (FIG. 10) mesh with each other such that the first stacker 39 can be driven by the first gear 35 (FIG. 10).

Figure 5:
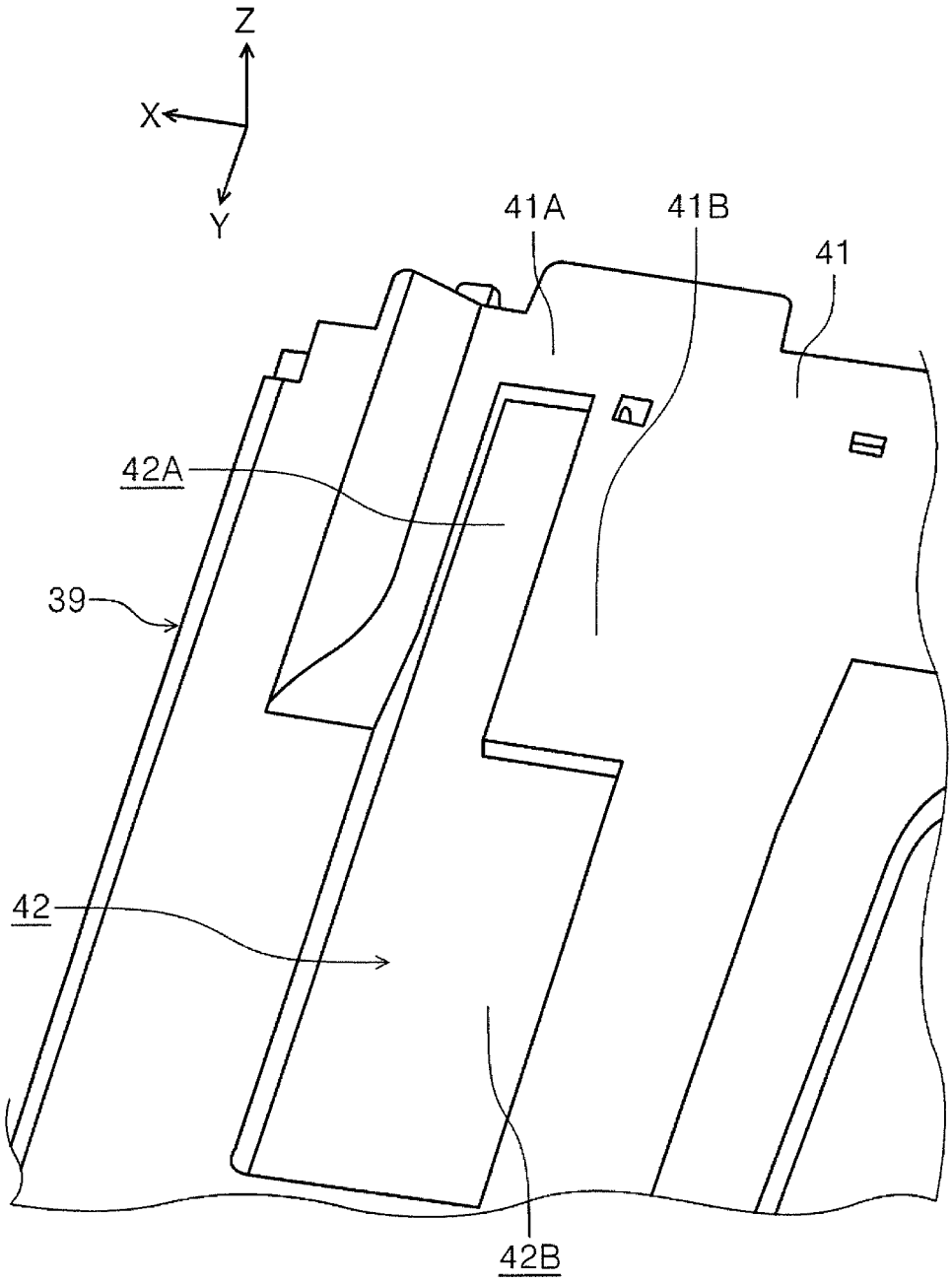
FIG. 5 is a perspective view of the stacker section according to the first embodiment.

As illustrated in FIG. 5, a recess 42 is recessed in the negative Z direction from the upper surface 41 and located in a position closer to the negative side of Y-axis and to the positive side of X-axis than a central portion of the first stacker 39. The recess 42 has a first recess 42A that extends in the Y direction and a second recess 42B that is shorter than the first recess 42A in the Y direction. An end of the second recess 42B on the negative side of Y-axis is closer to the positive side of Y-axis than an end of the first recess 42A on the negative side of Y-axis. In the upper surface 41, a peripheral edge portion of the first recess 42A on the negative side of Y-axis is referred to as a first contact portion 41A. In the upper surface 41, a peripheral edge portion of the second recess 42B on the negative side of Y-axis is referred to as a second contact portion 41B. The first stacker 39 (FIG. 2) has a protrusion (not illustrated) that protrudes in the negative Z direction.

As illustrated in FIG. 2, the second stacker 44 has a plate section 45 that has a predetermined thickness in the Z direction and a front wall section 46 that is disposed upright in the positive Z direction at an end of the plate section 45 on the positive side of Y-axis. Paper P is mounted on an upper surface 45A of the plate section 45 on the positive side of Z-axis. The rack section 49 (FIG. 11) is provided on a side of the plate section 45 on the negative side of X-axis. As illustrated in FIG. 11, the rack section 49 is disposed on the negative side of Z-axis with respect to the rack section 43 and extends in the Y direction. More specifically, the rack section 49 has recesses 49A that are recessed in the positive X direction and disposed along Y-axis at predetermined intervals. The recesses 49A and the teeth 36A (FIG. 10) mesh with each other such that the second stacker 44 can be driven by the second gear 36. The upper surface 45A (FIG. 2) has a protrusion (not illustrated) that protrudes in the positive Z direction. The protrusion is disposed so as to engage with the protrusion of the first stacker 39 to prevent the second stacker 44 from being pulled out in the Y direction.

In a state in which the first stacker 39 and the second stacker 44 are accommodated in the body 2, the rack section 49 and the second gear 36 are in mesh with each other. From this state, the second gear 36 is rotated to pull the second stacker 44 in the positive Y direction. In this state, the rack section 43 and the first gear 35 are out of mesh, and the first stacker 39 is not pulled. Then, the protrusion of the second stacker 44 comes into contact with the protrusion of the first stacker 39, causing the first stacker 39 to be pulled as the second stacker 44 is moved in the Y direction. With this structure, the rack section 43 and the first gear 35 mesh with each other, and the first stacker 39 is driven in the positive Y direction. To accommodate the first stacker 39 and the second stacker 44, this operation is reversely performed. With this structure, the first stacker 39 and the second stacker 44 can be automatically accommodated or pulled with respect to the body 2.

The first stacker 39 and the second stacker 44 are detachably attached to the body 2 at the above-described attachment/detachment position. The first stacker 39 and the second stacker 44 are detached by releasing the engagement of the part of the body 2 with the part of the first stacker 39 and the engagement of the part of the body 2 with the part of the second stacker 44. The first stacker 39 and the second stacker 44 are attached by engaging the part of the body 2 with the part the first stacker 39 and engaging of the part of the body 2 with the part the second stacker 44. The operation for attaching or detaching the stacker section 38 to or from the body 2 is performed by the user.

Figure 8:
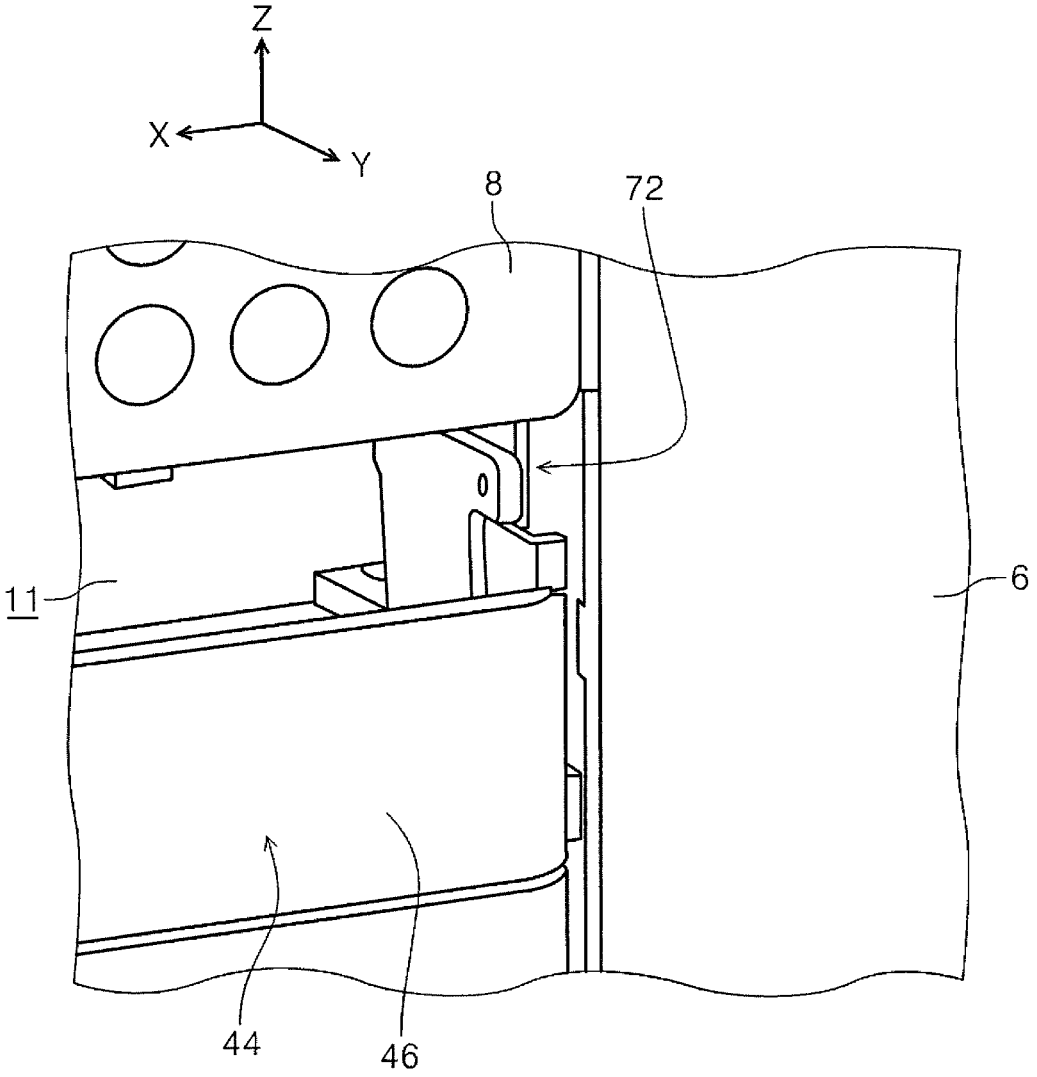
FIG. 8 is a perspective view in which the stacker section is accommodated and a protection section is in a release state according to the first embodiment.

As illustrated in FIG. 9, the front wall section 46 has, for example, a triangular prism shape with a central axis that extends in the X direction and has a front surface 47 that is disposed upright in the Z direction and an inclined surface 48 that extends obliquely downward from an end of the front surface 47 on the positive side of Z-axis. As illustrated in FIG. 8, the protection section 72, which will be described below, is disposed on the negative side of Y-axis with respect to the front wall section 46.

Figures 6, 7:
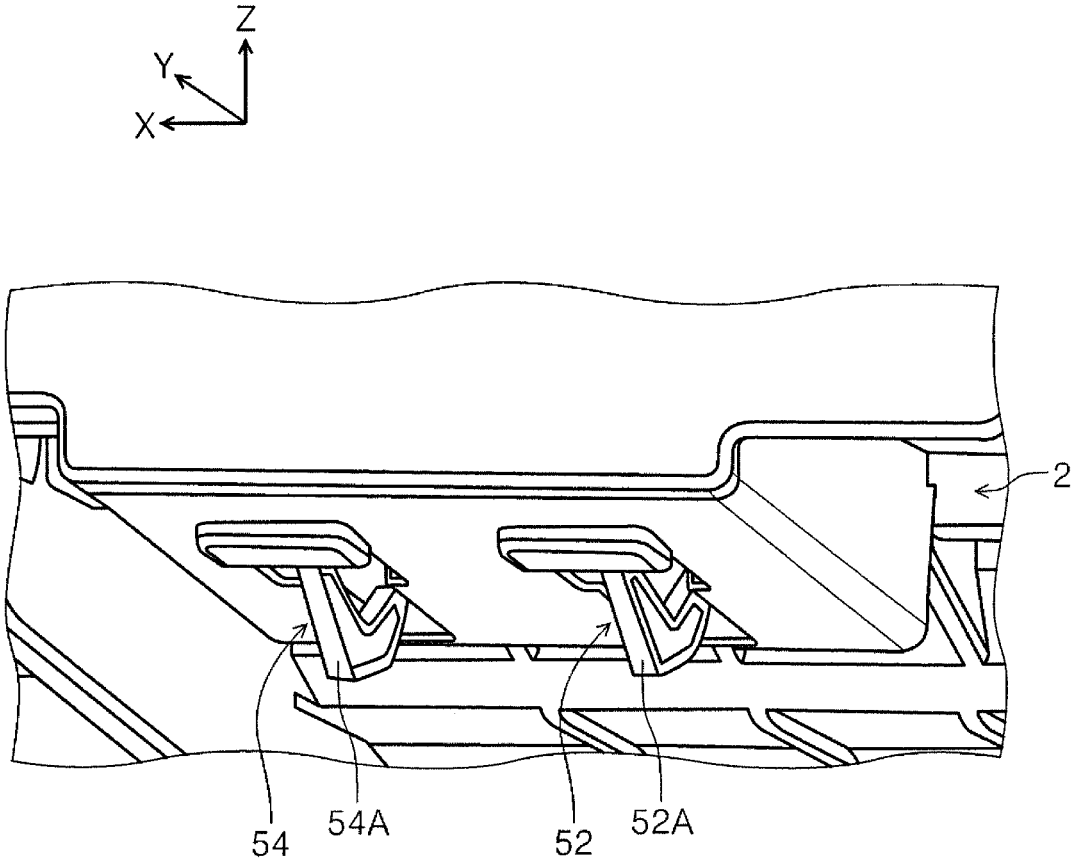
FIG. 6 is a perspective view of an A4 position sensor and an A3 position sensor according to the first embodiment.
FIG. 7 illustrates relationships among states of the stacker section, signals from the A4 position sensor, and signals from the A3 position sensor according to the first embodiment.

As illustrated in FIG. 6, the body 2 includes the A4 position sensor 52 and the A3 position sensor 54. The A4 position sensor 52 includes a lever section 52A and a switch section (not illustrated). The lever section 52A has a central axis extending in the X direction and can be turned around the central axis. The switch section is turned on or off depending on the turned position of the lever section 52A. The A4 position sensor 52 is turned off when the lever section 52A is moved into the second recess 42B (FIG. 5) and is turned on when the lever section 52A comes into contact with the second contact portion 41B (FIG. 5). The A3 position sensor 54 includes a lever section 54A and a switch section (not illustrated). The lever section 54A has a central axis extending in the X direction and can be turned around the central axis. The switch section is turned on or off depending on the turned position of the lever section 54A. The A3 position sensor 54 is turned off when the lever section 54A is moved into the first recess 42A (FIG. 5) and is turned on when the lever section 54A comes into contact with the first contact portion 41A (FIG. 5).

As illustrated in FIG. 4 and FIG. 7, a state in which only the A4 position sensor 52 is turned on is a state B that means an A4-size state. A state in which both of the A4 position sensor 52 and the A3 position sensor 54 are turned on is a state C that means an A3-size state. In a state A in which the stacker section 38 (FIG. 2) is accommodated in the body 2 (FIG. 2) and in a state D in which the stacker section 38 is detached from the body 2, both of the A4 position sensor 52 and the A3 position sensor 54 are turned off. In this structure, when the printer 1 (FIG. 1) is operated while the stacker section 38 is detached from the body 2, the stacker motor 33 (FIG. 4) can be driven and the pinion section 34 (FIG. 10) can be rotated. In such a case, dust is can enter the inside of the body 2 from the opening 19 (FIG. 10).

As illustrated in FIG. 4, the controller 60 includes a central processing unit (CPU) 61, a flash read-only memory (ROM) 62, and a random access memory (RAM) 63. The CPU 61 performs various arithmetic processing in accordance with a program stored in the flash ROM 62 and performs overall operational control of the printer 1. The controller 60 can communicate with an external computer 65. To the controller 60, a signal is input from the operation section 8B. The controller 60 also performs displaying on the display section 8A. The controller 60 also controls a carriage motor 64, a feed motor 66, a transport motor 67, and the stacker motor 33. The feed motor 66 is a drive source of a feed roller (not illustrated). The transport motor 67 is a drive source of a transport roller pair (not illustrated). Detection signals are input from the A4 position sensor 52 and the A3 position sensor 54 to the controller 60.

As illustrated in FIG. 9 and FIG. 10, the protection section 72 is disposed, when viewed in the X direction, such that the opening 19 can be opened or closed. The protection section 72 is provided so as to close the opening 19 with the movement of the stacker section 38 in the positive Y direction; in other words, the protection section 72 is switched to the protection state and protects the pinion section 34 in the protection state as the stacker section 38 is moved from the accommodation position to the detachment position. More specifically, in this embodiment, the protection section 72 is switched to the protection state while the stacker section 38 is moved from the A3 position (FIG. 3) that corresponds the above-described A3-size paper PB to the detachment position by a user operation. The protection section 72 is, accordingly, switched to the protection state for protecting the pinion section 34 when the stacker section 38 is detached from the body 2. More specifically, the protection section 72 is moved in the Z direction as the stacker section 38 is moved in the Y direction, and includes a cover member 78 that protects the pinion section 34 and a support frame 74 that supports the cover member 78.

The support frame 74 is an example support section and is disposed on the side wall 18 of the body 2. The support frame 74 supports the cover member 78 in the protection state for protecting the pinion section 34 with the cover member 78. More specifically, the support frame 74 includes an attachment section 75 and a frame body 76 and has a T shape when viewed in the X direction. In this embodiment, a protection position of the protection section 72 means, when viewed in the X direction, a position of the cover member 78 in which the cover member 78 covers the pinion section 34 and covers the opening 19. Here, "protection" of the pinion section 34 by the protection section 72 means to prevent or reduce movement of foreign matter such as dust toward the pinion section 34.

Figure 12:
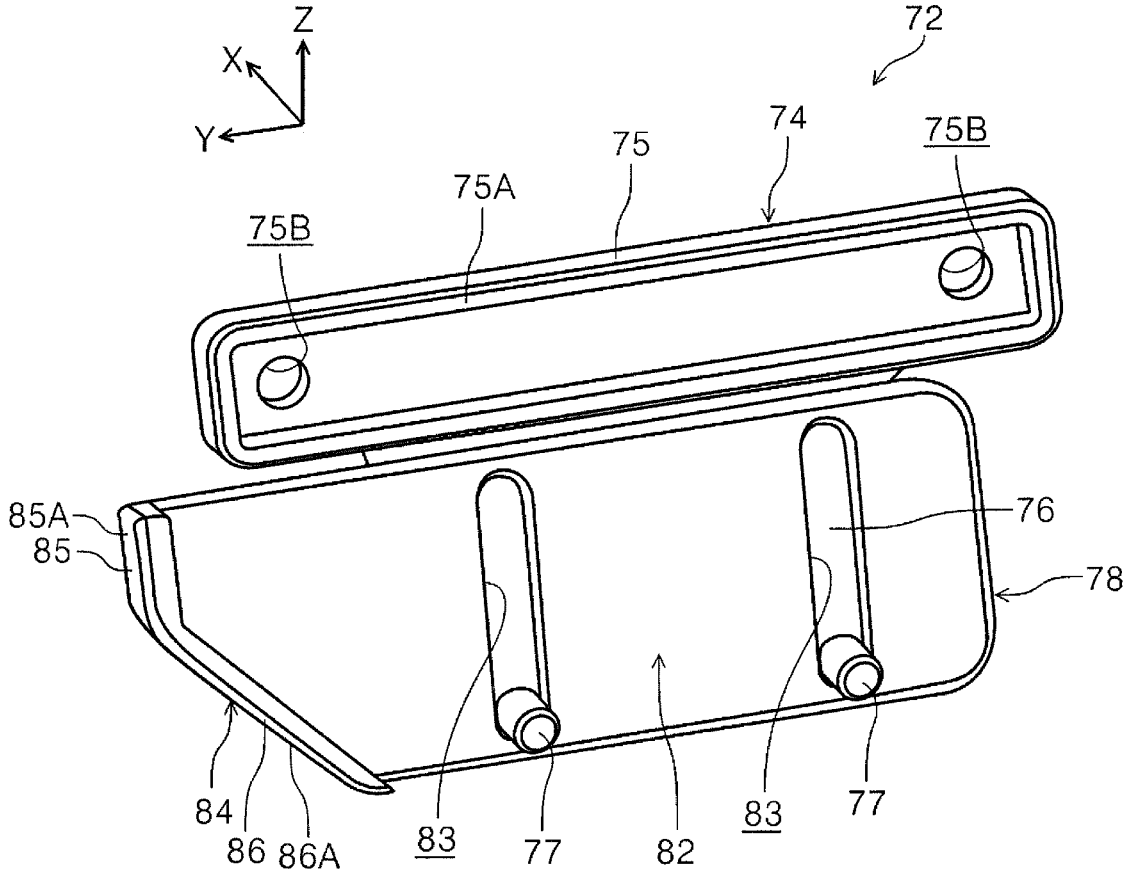
FIG. 12 is a perspective view a cover member that is retracted according to the first embodiment.

As illustrated in FIG. 9 and FIG. 12, the attachment section 75 is a plate-like member that has a predetermined thickness in the X direction. An outer peripheral portion of the attachment section 75 has a peripheral wall section 75A that protrudes in the negative X direction. The attachment section 75 has an elongated rectangular shape that is longer in the Y direction than in the Z direction when viewed in the X direction. The attachment section 75 has two attachment holes 75B that extend through in the X direction at both end portions of the attachment section 75 on Y-axis. The attachment section 75 is attached to the side wall 18 with screws 79 that are fastened to bosses 29 through the attachment holes 75B.

The frame body 76 extends in the negative Z direction from a portion other than the end portions of the attachment section 75 in the Y-axis. The frame body 76 has a plate-like shape that has a predetermined thickness in the X direction. The frame body 76 has, when viewed in the X direction, a quadrilateral shape that has sides along Z-axis and sides along Y-axis. The frame body 76 has two guide pins 77 disposed with a space therebetween in Y-axis at end portions of the frame body 76 on the negative side of Z-axis. The guide pins 77 protrude from the frame body 76 in the negative X direction. The guide pins 77 each have a cylindrical shape with a central axis that extends in the X direction and are fitted into the insertion sections 21 and 22 (FIG. 10). In a state in which the guide pins 77 are fitted into the insertion sections 21 and 22, the end of the frame body 76 on the negative side of Z-axis is located on the positive side of Z-axis with respect to the upper guide 27 (FIG. 10). In a state in which the guide pins 77 are fitted into the insertion sections 21 and 22 and the attachment section 75 is attached to the side wall 18, a space of a predetermined size is formed along X-axis between the frame body 76 and the guide rails 23 and 24 (FIG. 10). The cover member 78 can be moved in this space.

As illustrated in FIG. 12, the cover member 78 has a cover body 82 that has a predetermined thickness in the X direction and a front wall section 84 that protrudes in the negative X direction from an end of the cover body 82 on the positive side of Y-axis. The positive Y direction is an example moving direction in which the stacker section 38 is moved toward the attachment/detachment position. The cover body 82 is disposed between the frame body 76 and the side wall 18 (FIG. 9) in X-axis. The width of the cover body 82 in the Y direction is greater than the width of the frame body 76 in the Y direction. More specifically, the end of the cover body 82 on the negative side of Y-axis protrudes in the negative Y direction with respect to the frame body 76. The end of the cover body 82 on the positive side of Y-axis protrudes in the positive Y direction with respect to the frame body 76. In other words, the cover member 78 extends downstream in the positive Y direction with respect to the downstream end of the support frame 74. In the cover body 82, the portion that protrudes in the positive Y direction with respect to the frame body 76 has a trapezoidal shape in which a portion on the positive side of Y-axis and the negative side of Z-axis when viewed in the negative X direction is cut off in a triangle shape. The cover body 82 has, for example, two through holes 83.

The two through holes 83 extend through the cover body 82 in the X direction. Each of the through holes 83 extends in the Z direction. The length that corresponds to the width of each through hole 83 in the Y direction is greater than the length that corresponds to the diameter of each guide pin 77. Both ends of each through hole 83 in Z-axis have a semicircular shape when viewed in the X direction such that the ends can come into contact with part of the outer periphery of the guide pin 77. Into the two through holes 83, the guide pins 77 are inserted respectively. The sides of each through hole 83 come into contact with the guide pin 77 and are guided in the Z direction. More specifically, the cover member 78 that comes into contact with the stacker section 38 is guided by the guide pins 77 such that the cover member 78 can be slid in the Z direction, which is a direction of height of the body 2 (FIG. 1).

The protrusion length of the front wall section 84 with respect to the cover body 82 in the negative X direction is, for example, a length substantially the same as the protrusion length of the guide pin 77 with respect to the cover body 82 in the negative X direction. The front wall section 84 has, for example, a longitudinal wall 85 and an inclined wall 86. The longitudinal wall 85 is a plate-like wall that has a predetermined thickness in the Y direction and extends in the Z direction. More specifically, the longitudinal wall 85 extends from an upper end of the cover body 82 on the positive side of Z-axis to a position higher than a central part of the cover body 82 in Z-axis. The surface of the longitudinal wall 85 on the positive side of Y-axis is referred to as a front surface 85A. The inclined wall 86 extends, from the end of the longitudinal wall 85 on the negative side of Z-axis when viewed in the X direction, obliquely downward, which intersects the Z direction; in other words, the end of the inclined wall 86 on the negative side of Y-axis is located on the negative side of Z-axis with respect to the end on the positive side of Y-axis. The surface of the inclined wall 86 on the positive side of Y-axis is referred to as an inclined surface 86A. When the guide pins 77 come into contact with the sides of the through holes 83 on the negative side of Z-axis, the cover member 78 is in the highest position in the positive Z direction. This position is referred to as a retracted position of the cover member 78. When the cover member 78 is in the retracted position, the opening 19 (FIG. 10) is open.

Figure 13:
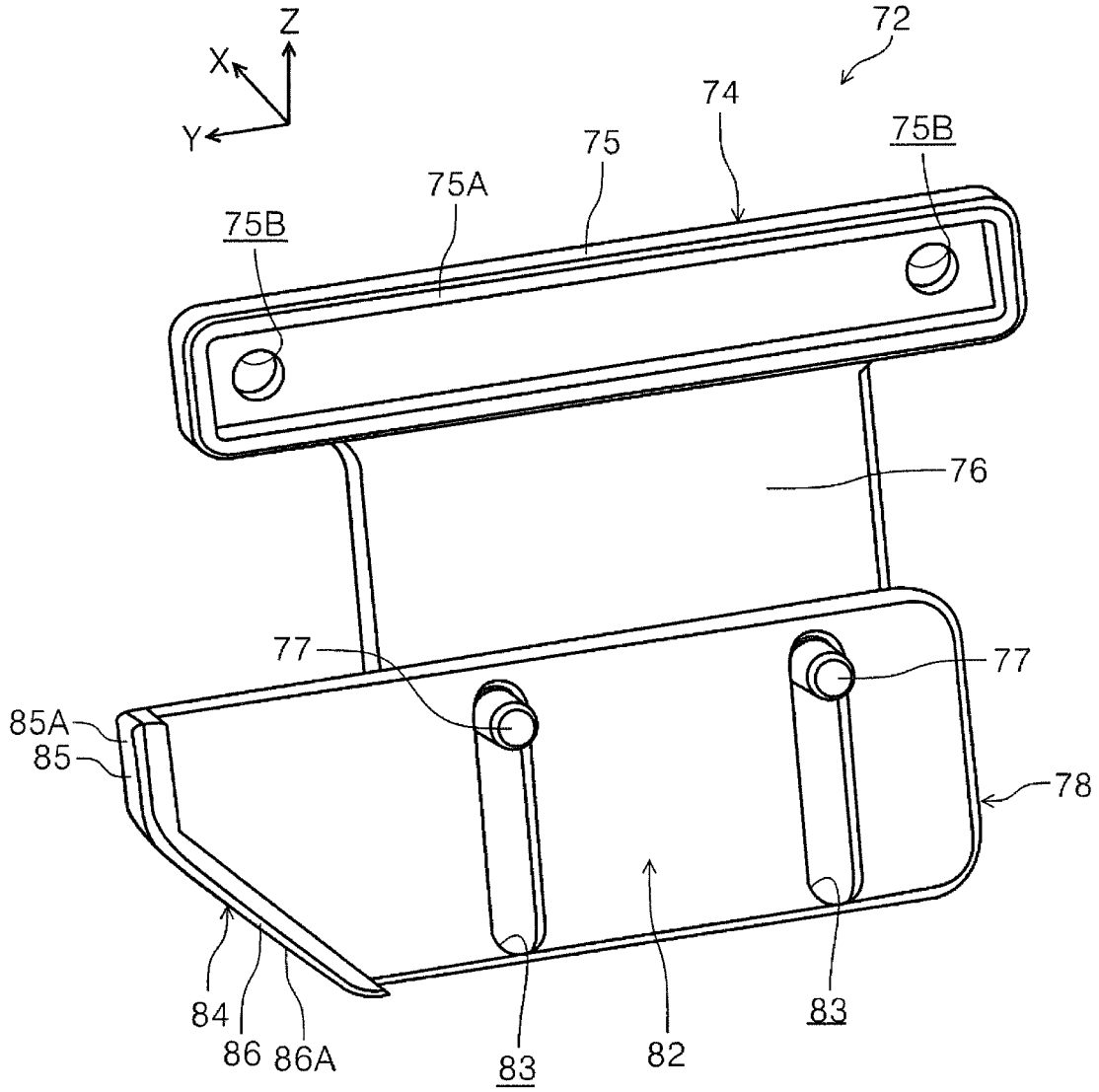
FIG. 13 is a perspective view of the cover member that is extended according to the first embodiment.

As illustrated in FIG. 13, when the guide pins 77 come into contact with the ends of the through holes 83 on the positive side of Z-axis, the cover member 78 is in the lowest position in the negative Z direction. The position corresponds to the protection position in which the cover member 78 is located in the protection state. When the cover member 78 is in the protection position, when viewed in the negative X direction, the opening 19 (FIG. 10) is closed.

Figure 14:
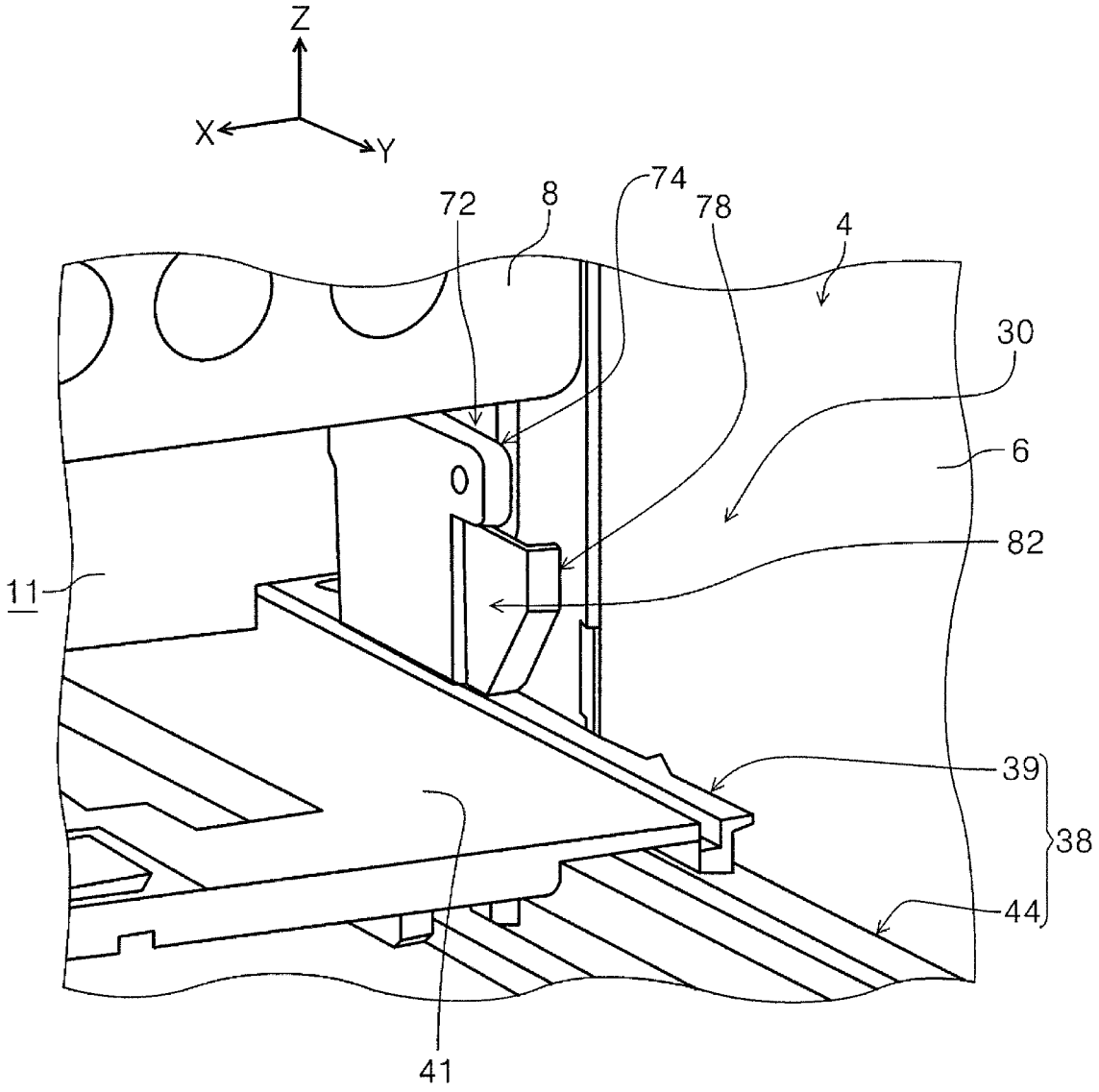
FIG. 14 is a perspective view in which the stacker section is pulled and the protection section is in a release state according to the first embodiment.

As illustrated in FIG. 14, when the first stacker 39 is accommodated in the body 2 and the cover member 78 is in the retraction position, a lower end of the cover body 82 on the negative side of Z-axis comes into contact with the upper surface 41; in other words, the cover member 78 can engage with the stacker section 38, and in a release state in which the protection of the pinion section 34 (FIG. 10) is released, the cover member 78 is supported by the stacker section 38.

Figure 15:
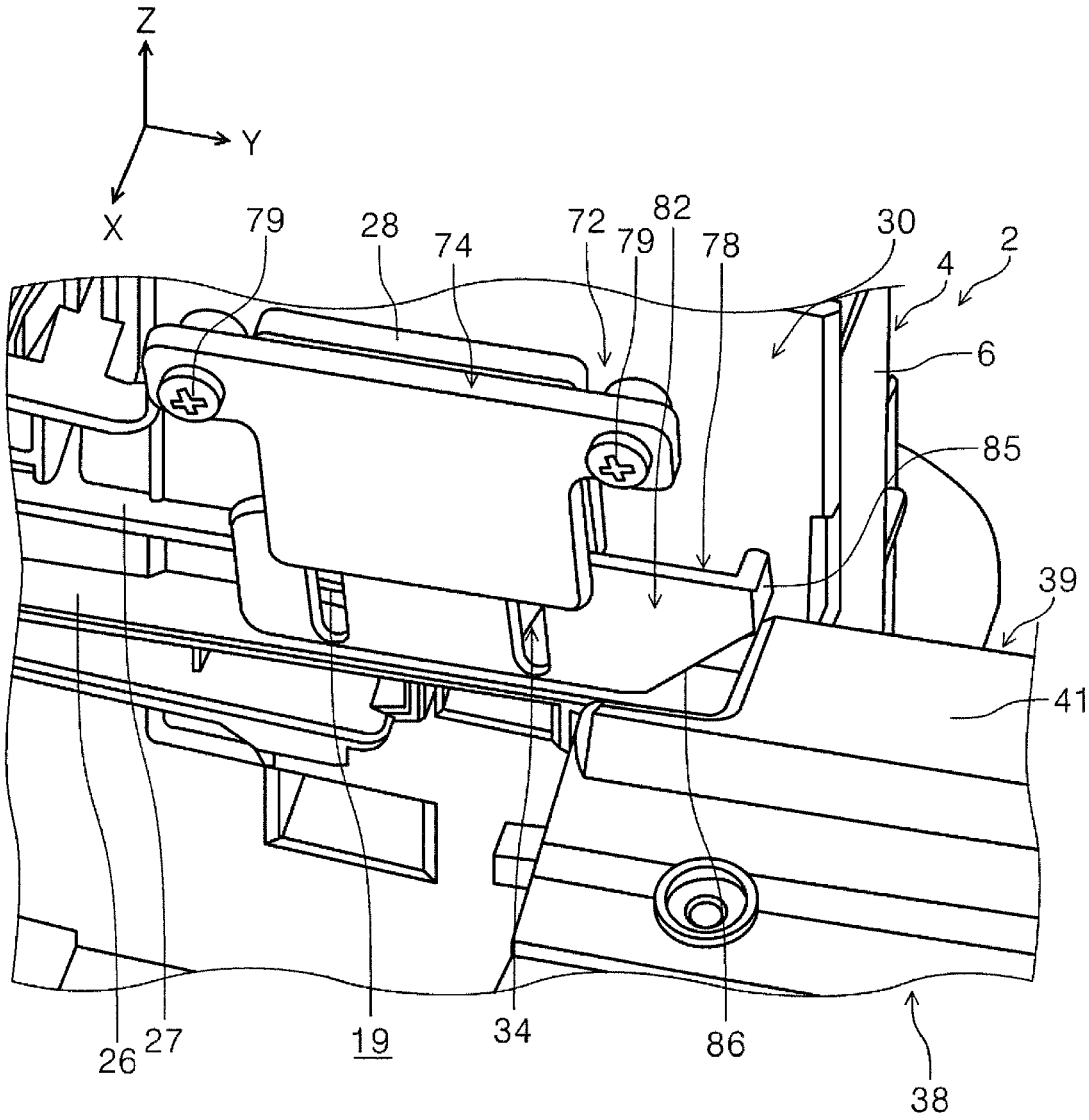
FIG. 15 is a perspective view of the cover member that covers an opening and protects the pinion section according to the first embodiment.

As illustrated in FIG. 15, when the stacker section 38 is pulled from the body 2 in the positive Y direction and the cover member 78 is in the protection position, when viewed in the X direction, the cover body 82 covers the opening 19 and the pinion section 34. When the cover member 78 is in the protection position and the stacker section 38 is not detached from the body 2, the inclined wall 86 faces an end of the first stacker 39 on the negative side of Y-axis in the Y direction. The protection section 72 according to the embodiment, in the protection state, covers the entire pinion section 34 and covers the entire opening 19 when viewed in the X direction. In addition, the protection section 72 according to the embodiment covers at least the portion of the pinion section 34 on the positive side of Y-axis when viewed in the Y direction. Because the portion of the pinion section 34 on the positive side of Y-axis is more likely to be exposed to dust or the like, the protection section 72 that covers the portion of the pinion section 34 on the positive side of Y-axis can effectively prevent or reduce dust or the like from accumulating on the pinion section 34. It should be noted that the detachment direction of the stacker section 38 is the positive Y direction as an example. The longitudinal wall 85 is on the positive side of Z-axis with respect to the first stacker 39 and does not face the first stacker 39 in the Y direction.

As described above, the protection section 72 can be switched between the protection state for protecting the pinion section 34 and the release state for releasing the protection of the pinion section 34. The protection section 72 is switched to the release state when the rack sections 43 and 49 in the stacker section 38 engage with the pinion section 34. The protection section 72 is switched from the release state to the protection state when the engagement of the rack sections 43 and 49 with the pinion section 34 is released.

Next, operations of the transport unit 30 according to the first embodiment will be described with reference to FIG. 1 to FIG. 16. The first stacker 39 and the second stacker 44 in the accommodation state in FIG. 1 are pulled in the positive Y direction from the body 2 as illustrated in FIG. 2 in response to driving of the pinion section 34 (FIG. 10). As illustrated in FIG. 14 and FIG. 15, when the first stacker 39 and the second stacker 44 are moved from the accommodation position beyond the A4 position and the A3 position to the attachment/detachment position, the cover member 78 is not supported by the first stacker 39, and the cover member 78 moves to the protection position by its own weight. With this structure, the pinion section 34 is protected by the cover member 78. When the first stacker 39 and the second stacker 44 are detached from the body 2, both the A4 position sensor 52 and the A3 position sensor 54 (FIG. 4) are turned off. In this state, however, the first stacker 39 and the second stacker 44 may be erroneously determined that the first stacker 39 and the second stacker 44 are in the accommodation state. In such a case, in the state in which the first stacker 39 and the second stacker 44 are detached from the body 2, the pinion section 34 may be driven and the pinion section 34 may be exposed to dust or the like. In the transport unit 30, however, even when the pinion section 34 is rotated, the pinion section 34 is protected by the cover member 78, and thus the accumulation of dust or the like onto the pinion section 34 can be prevented or reduced as compared to a structure that is not provided with the cover member 78.

Figure 16:
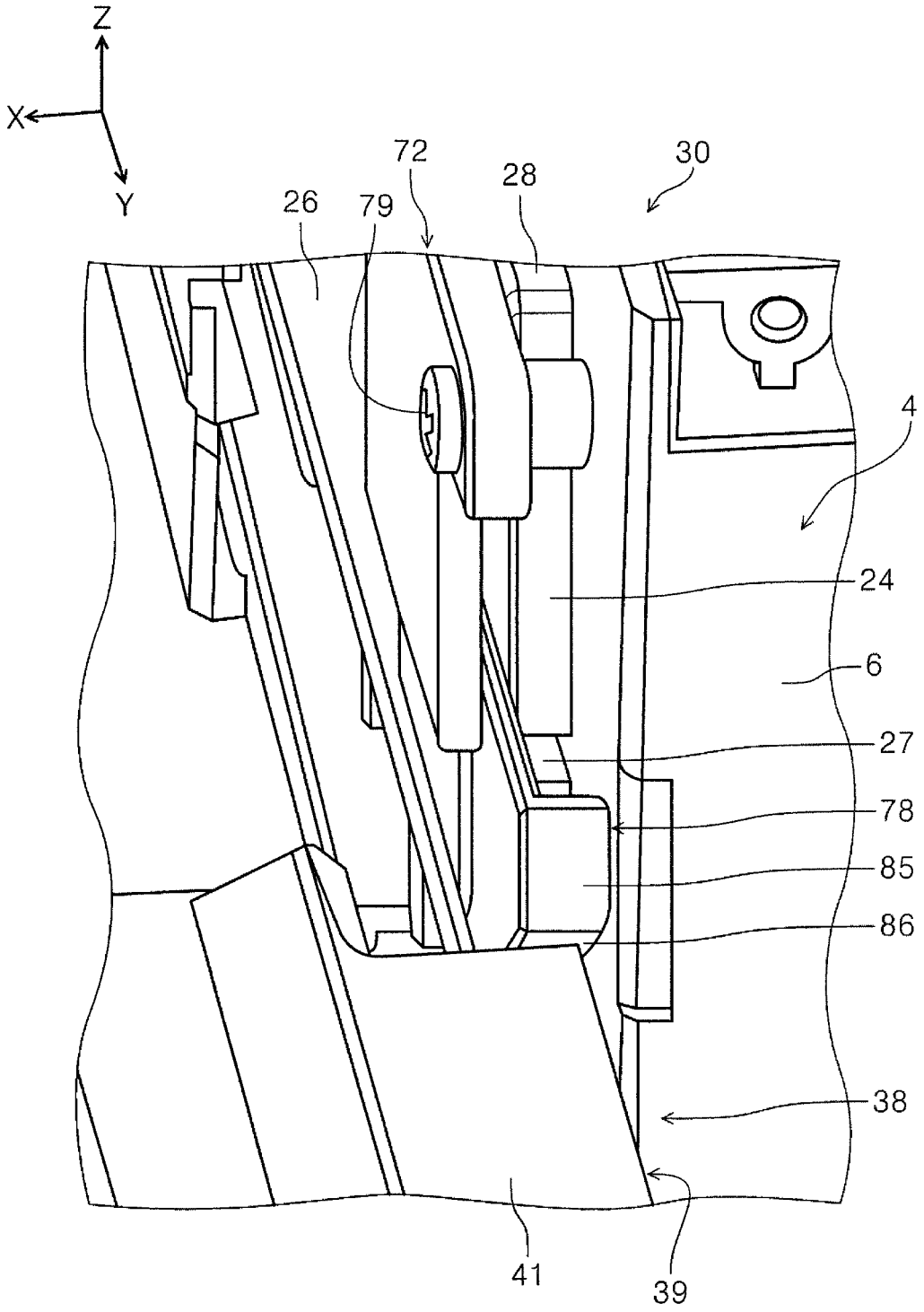
FIG. 16 is a perspective view in which part of the stacker section is in contact with an inclined wall of the cover member according to the first embodiment.

As illustrated in FIG. 16, when the first stacker 39 is attached to the body 2 and is moved from the attachment/detachment position in the negative Y direction, the end of the first stacker 39 on the negative side of Y-axis comes into contact with the inclined wall 86. By the operation, the moving force acts on the cover member 78 in the negative Y direction. Then, the cover member 78 comes into contact with the guide pins 77 (FIG. 12) and is moved in the positive Z direction. In other words, the moving force in the negative Y direction received from the first stacker 39 is changed into a moving force in the positive Z direction to the cover member 78. As illustrated in FIG. 14, when the stacker section 38 is accommodated in the accommodation position, the cover member 78 is located in the retraction position, and the cover member 78 is supported by the stacker section 38.

As described above, in the transport unit 30, the stacker section 38 is driven by the pinion section 34 in the drive unit 32 to move in the moving direction, which is the positive Y direction or the negative Y direction. Here, when the engagement of the rack sections 43 and 49 with the pinion section 34 is released, the protection section 72 is switched from the release state to the protection state to protect the pinion section 34. Accordingly, the protection section 72 can prevent or reduce the entry of dust or the like from the outside of the body toward the pinion section 34, thus preventing or reducing the accumulation of dust or the like entered from the outside of the body 2 onto the pinion section 34. In addition, although the pinion section 34 is more likely to be exposed to dust or the like when the stacker section 38 is detached from the body 2, in the transport unit 30, the protection section 72 is switched to the protection state when the stacker section 38 is detached from the body 2, thus preventing or reducing the accumulation of dust or the like onto the pinion section 34 when the stacker section 38 is detached from the body 2. In addition, the portion of the pinion section 34 on the positive side of Y-axis, along which the stacker section 38 is pulled, is more likely to be exposed to dust or the like than the portion of the pinion section 34 on the negative side of Y-axis, along which the stacker section 38 is accommodated. The transport unit 30, however, in the protection state, covers at least the portion of the pinion section 34 on the positive side of Y-axis with the protection section 72, and when the stacker section 38 is pulled further in the positive Y direction, the exposure of the part of the pinion section 34 can be prevented or reduced. Accordingly, the accumulation of dust or the like onto the pinion section 34 can be effectively prevented or reduced.

The transport unit 30 supports the cover member 78 with the support frame 74 in the protection state for protecting the pinion section 34. This structure can regulate the change in position of the cover member 78 in the protection state, thus preventing or reducing the entry of dust or the like toward the pinion section 34. In addition, in the transport unit 30, the cover member 78 descends by its own weight and protects the pinion section 34, thus eliminating any other structure for sliding the cover member 78 toward the protection position. In addition, in the release state, the cover member 78, which descends by its own weight, is supported by the stacker section 38, thus eliminating any other structure for supporting the cover member 78.

In the transport unit 30, the cover member 78 extends in the positive Y direction, and an angle of the portion of the cover member 78 that engages with the stacker section 38 with respect to Y-axis can be gentle. More specifically, as compared with a structure in which the cover member 78 extends less than the frame body 76 in the positive Y direction, the angle of the inclined wall 86 with respect to Y-axis is small, and accordingly, the cover member 78 can be smoothly raised in the positive Z direction in attaching the stacker section 38 to the body 2. In addition, in the transport unit 30, the stacker section 38 comes into contact with the cover member 78 and the cover member 78 is moved. This structure directly changes the moving force of the stacker section 38 into the moving force to the cover member 78, enabling effective use of the moving force of the stacker section 38 in moving the cover member 78. The printer 1 can achieve effects similar to those of the transport unit 30. In addition, in the printer 1, the accumulation of dust or the like to the pinion section 34 can be prevented or reduced, and the stacker section 38 can be prevented from being stopped during its movement. Accordingly, recorded paper P can be reliably mounted to a predetermined position on the stacker section 38.

Second Embodiment

Next, a transport unit 90 according to a second embodiment, which is an example transport apparatus according to the present disclosure, will be described in detail with reference to the attached drawings. To components similar to those in the first embodiment, the same reference numerals are given to omit their descriptions. In addition, descriptions of operations and effects similar to those in the first embodiment will be omitted.

Figure 17:
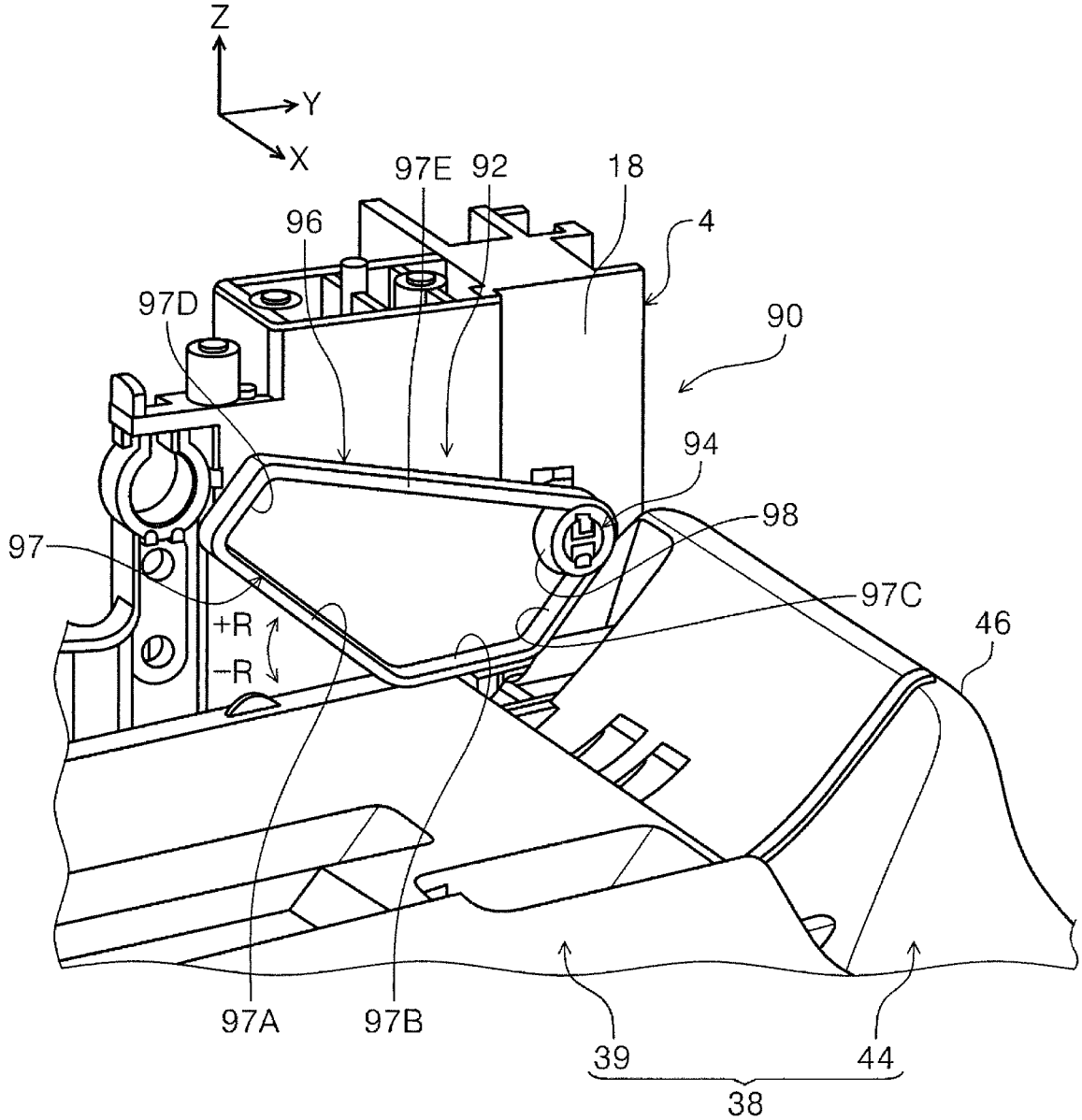
FIG. 17 is a perspective view of a protection section that is in a release state according to a second embodiment.

The transport unit 90 illustrated in FIG. 17 is provided in place of the transport unit 30 (FIG. 1) in the printer 1 (FIG. 1). The transport unit 90 includes a protection section 92 in place of the protection section 72 (FIG. 15) in the transport unit 30. The protection section 92 includes a cover member 96 that is turned as the stacker section 38 moves in the Y direction and a shaft 94 that is an example support section that supports the cover member 96. The shaft 94 protrudes from the side wall 18 in the positive X direction. More specifically, the shaft 94 extends in the X direction, which is an intersecting direction in which the shaft 94 intersects the Y direction in which the stacker section 38 moves. The shaft 94 has a cylindrical shape with a central axis that extends in the X direction.

The cover member 96 is a plate-like member that has a predetermined thickness in the X direction. An outer peripheral portion 97 of the cover member 96 extends in the positive X direction, that is, the outer peripheral portion 97 has a flange-like shape. More specifically, the outer peripheral portion 97 has a lower flange 97A, an inclined flange 97B, a front flange 97C, a rear flange 97D, and an upper flange 97E. A supported section 98 is provided between the front flange 97C and the upper flange 97E. The cover member 96 and the side wall 18 are spaced such that the pinion section 34 (FIG. 10) and the cover member 96 do not come into contact with each other.

Figure 18:
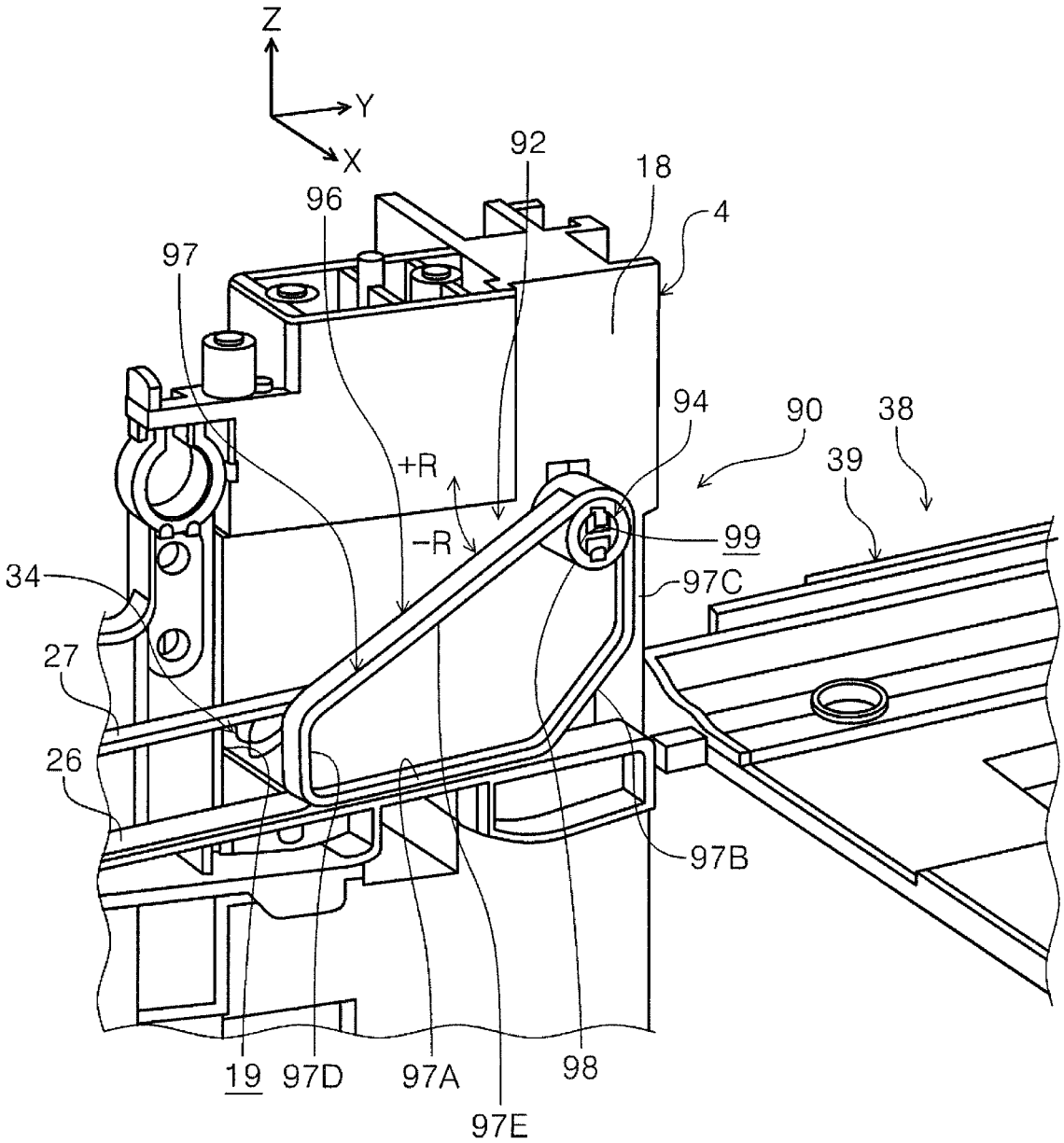
FIG. 18 is a perspective view of a cover member that covers an opening and protects the pinion section according to the second embodiment.

As illustrated in FIG. 18, when the stacker section 38 is detached from the body 2, the lower flange 97A is disposed along Y-axis. The position of the cover member 96 is referred to as a protection position in which the lower flange 97A is disposed along Y-axis. A position of the cover member 96 in which the inclined flange 97B is disposed along Y-axis is referred to as an initial position (FIG. 17). Positions of the portions of the outer peripheral portion 97 will be described on the assumption that the cover member 96 is in the protection position. The state in which the cover member 96 is in the protection position is a protection state in which the pinion section 34 is protected. The state in which the cover member 96 is in the initial position is a release state in which the protection of the pinion section 34 is released.

The lower flange 97A extends in the Y direction. The length of the lower flange 97A in the Y direction is longer than the length of the opening 19 in the Y direction. The inclined flange 97B extends obliquely upward from an end of the lower flange 97A on the positive side of Y-axis; in other words, the inclined flange 97B extends in a direction intersecting the Z direction such that the positive end in Y-axis is located on the positive side of Z-axis with respect to the negative end in Y-axis. The inclined flange 97B is disposed along Y-axis when the cover member 96 is in the initial position and the inclined flange 97B is supported by the first stacker 39; in other words, the cover member 96 is supported by the stacker section 38 in a state in which the cover member 96 releases the protection of the pinion section 34.

The front flange 97C extends in the positive Z direction from an end of the inclined flange 97B on the positive side of Y-axis. The front flange 97C extends to the supported section 98. The front flange 97C functions as a recess for avoiding contact with the front wall section 46 (FIG. 17) when the cover member 96 is in the initial position. The rear flange 97D extends in the positive Z direction from an end of the lower flange 97A on the negative side of Y-axis. The length of the rear flange 97D in the Z direction is, for example, shorter than the length of the front flange 97C in the Z direction. The upper flange 97E extends obliquely upward from an end of the rear flange 97D on the positive side of Z-axis; in other words, the upper flange 97E extends in a direction intersecting the Z direction such that the positive end in Y-axis is located on the positive side of Z-axis with respect to the negative end in Y-axis. For example, an angle which the upper flange 97E forms with respect to Y-axis is smaller than an angle which the inclined flange 97B forms with respect to Y-axis.

The supported section 98 has a cylindrical shape with a central axis that extends in the X direction; in other words, the supported section 98 has a through hole 99. The through hole 99 extends through the cover member 96 in the X direction. Into the through hole 99, the shaft 94 is inserted. As described above, the supported section 98 that is turnable about the shaft 94 enables the cover member 96 to be turned about the shaft 94 along the Y-Z surface. The cover member 96 is turned as the stacker section 38 is moved, protecting the pinion section 34. Note that, when viewed from the positive side of X-axis to the negative side of X-axis, a clockwise direction is referred to as a positive R direction, and a counterclockwise direction is referred to as a negative R direction.

Next, operations of the transport unit 90 according to the second embodiment will be described. As illustrated in FIG. 17, in a state in which the stacker section 38 is in the accommodation state, the stacker section 38 is pulled in the positive Y direction from the body 2 in response to driving of the pinion section 34 (FIG. 10). As illustrated in FIG. 18, when the first stacker 39 is moved from the accommodation position to the attachment/detachment position, the cover member 96 is not supported by the first stacker 39, and the cover member 96 turns in the negative R direction by its own weight and moves to the protection position. With this structure, the pinion section 34 is protected by the cover member 96. In this state, as described above, while the stacker section 38 is detached from the body 2, the pinion section 34 may be driven and dust or the like may move toward the pinion section 34. In the transport unit 90, however, even when the pinion section 34 is rotated, the pinion section 34 is protected by the cover member 96, thus preventing or reducing the accumulation of dust or the like onto the pinion section 34.

When the stacker section 38 is attached to the body 2 and is moved from the attachment/detachment position in the negative Y direction, the end of the first stacker 39 on the negative side of Y-axis comes into contact with the inclined flange 97B. By the operation, the moving force in the positive R direction acts on the cover member 96; in other words, the moving force in the negative Y direction received from the first stacker 39 is changed into a moving force in the positive R direction. As illustrated in FIG. 17, when the first stacker 39 is accommodated in the accommodation position, the cover member 96 is in the initial position, and the cover member 96 is supported by the stacker section 38.

As described above, the transport unit 90 achieves the narrower moving range of the portion of the cover member 96 that turns about the shaft 94 than the moving range of a portion of the cover member 96 remote from the shaft 94. Accordingly, as compared to a structure in which the entire cover member 96 slides in one direction, this structure enables the narrower moving range for the entire cover member 96, that is, the space for the cover member 96 to move to the protection position is small, thus enabling the compact body 2. In addition, when the cover member 96 is in the release state in which the protection of the pinion section 34 is released, the cover member 96 is supported by the stacker section 38 and the movement of the cover member 96 in the negative R direction is regulated; accordingly, the position of the cover member 96 can be held in the release state.

The printer 1 according to the first or second embodiment of the present disclosure and the transport unit 30 and the transport unit 90 basically have the above-described structures; however, the structures may be partially modified or omitted without departing from the scope of the present disclosure.

Figure 19:
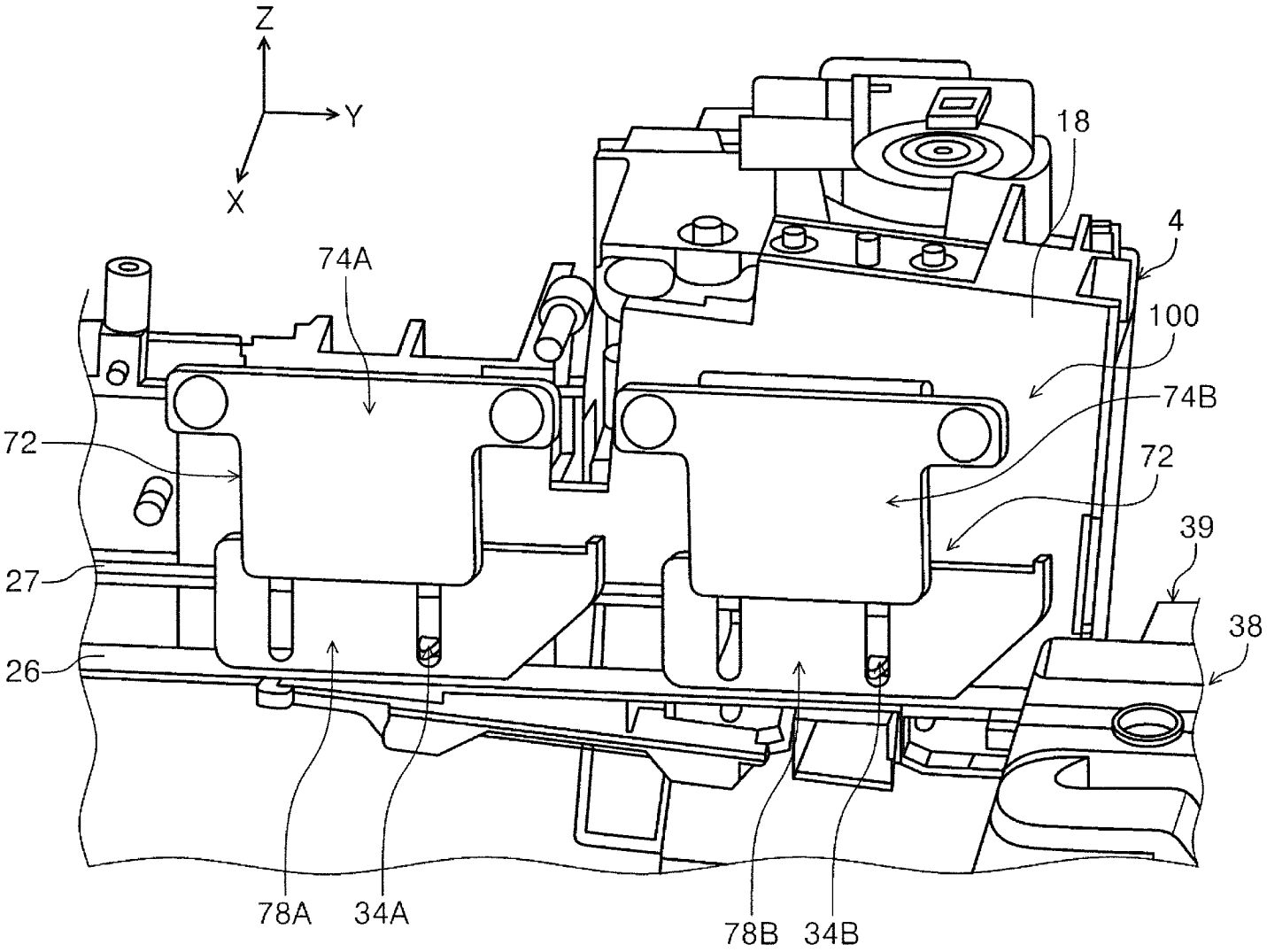
FIG. 19 is a perspective view of a protection section that is in a protection state according to a modification.

FIG. 19 illustrates a transport unit 100 according to a modification of the first embodiment. To components similar to those in the first embodiment, the same reference numerals are given to omit their descriptions. In this modification, two pinion sections 34 are disposed in Y-axis. The transport unit 100 includes two protection sections 72. The transport unit 100 is similar to the transport unit 30 (FIG. 9) except that another protection section 72 is provided. The two protection sections 72 are aligned on Y-axis. To distinguish the two protection sections 72, the protection section 72 on the negative side of Y-axis is referred to as a protection section 72A, and the protection section 72 on the positive side of Y-axis is referred to as a protection section 72B.

Figure 20:
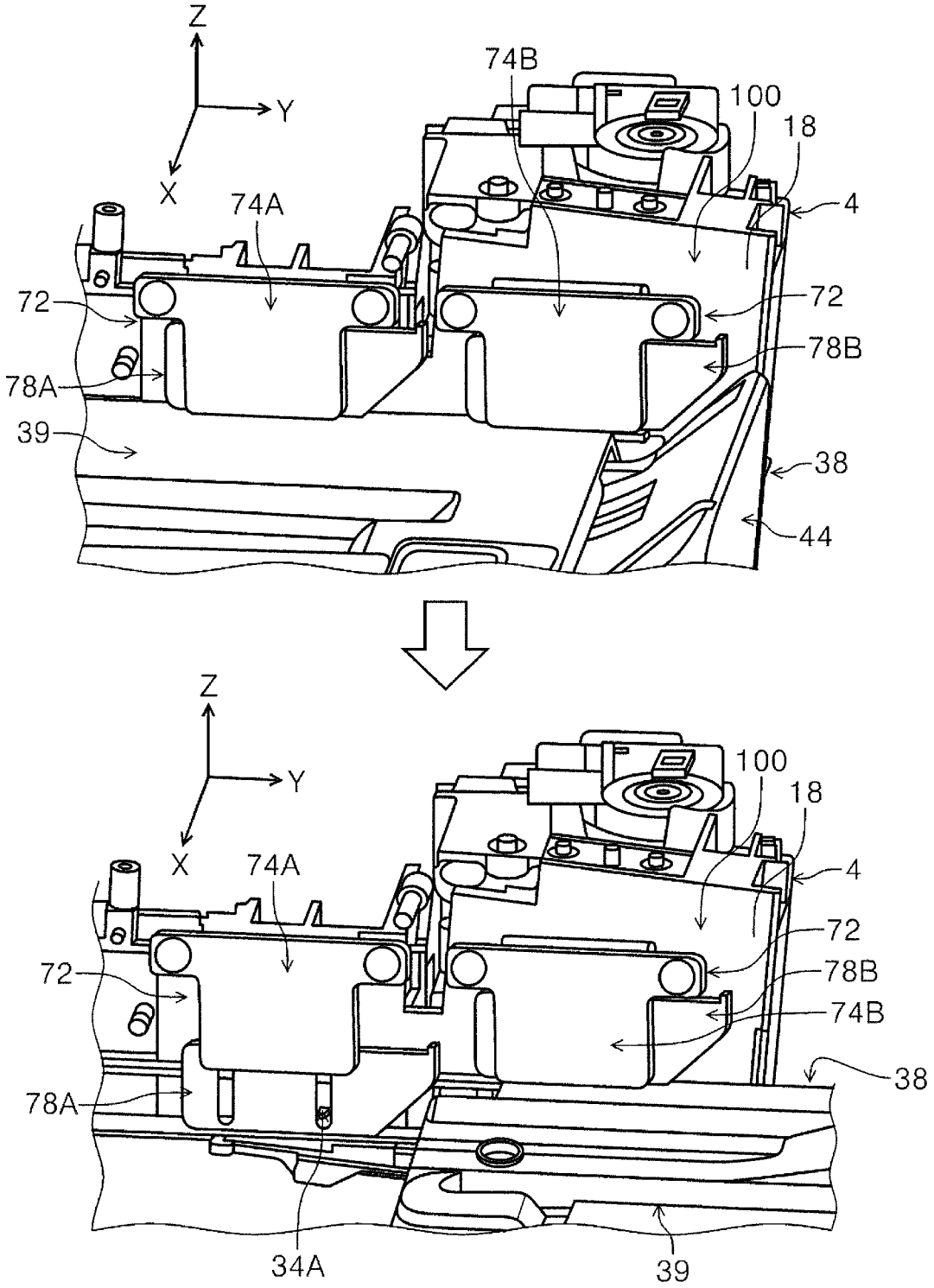
FIG. 20 is a perspective view of a cover member that covers an opening and protects a pinion section according to the modification.

As illustrated in the upper drawing in FIG. 20, in a state in which the stacker section 38 is in the accommodation state, the stacker section 38 is pulled in the positive Y direction from the body 2 in response to driving of the pinion section 34 (FIG. 19). Then, as illustrated in the lower drawing in FIG. 20, while the stacker section 38 is being pulled, a cover member 78A on the negative side of Y-axis descends in the negative Z direction to the protection state, thereby protecting a pinion section 34A. In this state, a cover member 78B on the positive side of Y-axis is in the release state. Then, as illustrated in FIG. 19, when the stacker section 38 is pulled to the attachment/detachment position, the cover member 78B on the positive side of Y-axis descends in the negative Z direction to the protection state, thereby protecting a pinion section 34B. Accordingly, both the cover members 78A and 78B are in the protection state. In this state, even if the pinion sections 34A and 34B are erroneously rotated, the pinion sections 34A and 34B are protected by the cover members 78A and 78B, thereby preventing or reducing the accumulation of dust or the like onto the pinion sections 34A and 34B.

As illustrated in the upper drawing in FIG. 20, when the stacker section 38 is attached to the body 2 and is moved in the negative Y direction from the attachment/detachment position toward the accommodation position, the first stacker 39 comes into contact with the cover members 78B and 78A. With this structure, the cover members 78A and 78B are moved into the retraction position in the order of the cover member 78B and the cover member 78A. The cover members 78A and 78B are supported by the first stacker 39. Then, the second stacker 44 is accommodated. As in the modification, the plurality of protection sections 72 may be provided.

In another modification, the cover member 78 may be urged in the negative Z direction by using an urging member such as a spring. The cover member that is urged in the negative Z direction can more reliably move the cover member 78 toward the protection position. The support frame 74 may be disposed on the negative side of Z-axis with respect to the cover member 78, and the cover member 78 may be urged in the positive Z direction by using an urging member such as a spring. In a state in which the stacker section 38 is detached, the cover member 78 protrudes in the movement path of the stacker section 38 to protect the pinion section 34. The inclined wall 86 of the cover member 78 is disposed on the positive side of Z-axis with respect to the longitudinal wall 85. When the stacker section 38 is moved to the accommodation position, the first stacker 39 and the inclined wall 86 come into contact with each other to move the cover member 78 in the negative Z direction from the protection position and to the retraction position. As described above, the position of the protection section 72 may be reversed on Z-axis.

In the transport unit 30, the stacker section 38 may be partly supported by the body 2 without being detached from the body 2. The cover member 78 may protect the pinion section 34 not only in the positive Y direction but also in the negative Z direction and the negative Y direction; that is, the cover member 78 may cover the entire or part of the pinion section 34. In addition, the cover member 78 may cover the entire or part of the opening 19. The support frame 74 may be a support section that is provided in the body 2. The cover member 78 may be slidable in a direction intersecting the Z direction when viewed in the X direction. The portion of the cover member 78 on the positive side of Y-axis may be aligned with the portion of the support frame 74 on the positive side of Y-axis, and the cover member 78 may protrude only in the Z direction with respect to the support frame 74. In the transport unit 30, for example, a magnet may be provided in each of the first stacker 39 and the cover member 78, and the first stacker 39 may be moved to move the cover member 78 in a noncontact manner by using the repulsion of the magnets.

In the transport unit 90, the cover member 96 may not be directly supported by the stacker section 38 in a state in which the cover member 96 releases the protection of the pinion section 34. That is, the stacker section 38 may move another supporting member such that the other supporting member support the cover member 96.

In place of the A4 position sensor 52 and the A3 position sensor 54, the load on the stacker motor 33 may be detected to determine the accommodation state or the detached state of the stacker section 38. The mounting section is not limited to the stacker section 38 that is used in the discharge section of the printer 1, and any component that is used in a sheet feeding section such as the sheet cassettes 12 and 14 may be employed. The medium is not limited to paper P and any sheet material such as a film or a recorded document may be used.

What is claimed is:

1. A transport apparatus comprising:

a mounting section on which a medium is to be mounted, the mounting section being configured to be moved, as a moving direction, in a pull direction in which the mounting section is pulled from an apparatus body or in an accommodation direction opposite to the pull direction;

a drive section configured to drive the mounting section in the moving direction; and a protection section configured to be switched between a protection state for protecting the drive section and a release state for releasing protection of the drive section, wherein the mounting section has a driven section that engages with the drive section and is driven by the drive section, when the driven section engages with the drive section, the protection section is in the release state, and when the driven section does not engage with the drive section, the protection section is in the protection state.

2. The transport apparatus according to claim 1, wherein the mounting section is configured to be detached from or attached to the apparatus body, and the protection section is in the protection state when the mounting section is detached from the apparatus body.

3. The transport apparatus according to claim 2, wherein the protection section includes a cover member configured to come into contact with the mounting section and to be moved to protect the drive section as the mounting section moves, and a support section configured to support the cover member in the protection state.

4. The transport apparatus according to claim 3, wherein the cover member is configured to be slid in a direction of height of the apparatus body and to be supported by the mounting section in the release state.

5. The transport apparatus according to claim 4, wherein the cover member extends downstream in the pull direction with respect to a downstream end of the support section.

6. The transport apparatus according to claim 3, wherein the support section is a shaft extending in a direction intersecting the moving direction, and the cover member is configured to be turned about the shaft to be in the release state or the protection state as the mounting section moves.

7. The transport apparatus according to claim 6, wherein the cover member is configured to be supported by the mounting section in the release state.

8. The transport apparatus according to claim 1, wherein the protection section covers in the protection state at least a portion of the drive section on a pull side.

9. The transport apparatus according to claim 1, wherein the protection section includes a cover member configured to come into contact with the mounting section and to be moved to protect the drive section as the mounting section moves, and a support section configured to support the cover member in the protection state.

10. The transport apparatus according to claim 9, wherein the cover member is configured to be slid in a direction of height of the apparatus body and to be supported by the mounting section in the release state.

11. The transport apparatus according to claim 10, wherein the cover member extends downstream in the pull direction with respect to a downstream end of the support section.

12. The transport apparatus according to claim 9, wherein the support section is a shaft extending in a direction intersecting the moving direction, and the cover member is configured to be turned about the shaft to be in the release state or the protection state as the mounting section moves.

13. The transport apparatus according to claim 12, wherein the cover member is configured to be supported by the mounting section in the release state.

14. A recording apparatus comprising:

a recording section configured to perform recording on a medium; and the transport apparatus according to claim 1 configured to transport the medium.

* * * * *